US007231965B2

(12) United States Patent
Shimoya et al.

(10) Patent No.: US 7,231,965 B2
(45) Date of Patent: Jun. 19, 2007

(54) HEAT EXCHANGER AND HEAT TRANSFERRING MEMBER WITH SYMMETRICAL ANGLE PORTIONS

(75) Inventors: Masahiro Shimoya, Kariya (JP); Noriyuki Kasuya, Nukata-gun (JP); Eiichi Torigoe, Anjo (JP); Tatsuo Ozaki, Okazaki (JP)

(73) Assignee: DENSO Corporation, Kariya (JP)

( * ) Notice: Subject to any disclaimer, the term of this patent is extended or adjusted under 35 U.S.C. 154(b) by 469 days.

(21) Appl. No.: 10/802,697

(22) Filed: Mar. 17, 2004

(65) Prior Publication Data

US 2004/0206484 A1 Oct. 21, 2004

(30) Foreign Application Priority Data

Mar. 19, 2003 (JP) ..... 2003-075792
Sep. 24, 2003 (JP) ..... 2003-331735

(51) Int. Cl.
*F28D 1/02* (2006.01)

(52) U.S. Cl. ..... 165/151; 165/152; 165/181

(58) Field of Classification Search ..... 165/151, 165/152, 181
See application file for complete search history.

(56) References Cited

U.S. PATENT DOCUMENTS

| | | | | |
|---|---|---|---|---|
| 4,469,168 | A * | 9/1984 | Itoh et al. | 165/152 |
| 5,329,988 | A * | 7/1994 | Juger | 165/153 |
| 6,401,809 | B1 * | 6/2002 | Zhang et al. | 165/146 |
| 2002/0129929 | A1 * | 9/2002 | Iwasaki et al. | 165/152 |
| 2002/0189799 | A1 * | 12/2002 | Ozaki | 165/152 |
| 2005/0167088 | A1 * | 8/2005 | Paulman | 165/152 |

FOREIGN PATENT DOCUMENTS

JP 63-83591 4/1988

* cited by examiner

*Primary Examiner*—Leonard R. Leo
(74) *Attorney, Agent, or Firm*—Harness, Dickey & Pierce, PLC

(57) ABSTRACT

A plurality of angle portions 2*c* of the fins on an upstream side and those on a downstream side of an air flow are provided so as to be substantially symmetrical with each other. Due to this, bending forces are continuously exerted on a thin plate-like fin material in a direction where the bending deformation of the fin material is cancelled, during the fin forming process. Accordingly, when the angle portions 2*c* are formed it can be prevented in advance that the fin material 11 is deformed in a state where the repeated deformations of the fin material 11 are accumulated in the same direction.

22 Claims, 22 Drawing Sheets

A-A SECTION

5mm<B≦25mm AND Cn<1mm

A-A SECTION

SLIT LENGTH RATIO (E) = ANGLE PORTION LENGTH (D) / FIN LENGTH (C)

HEAT EXCHANGER AND HEAT TRANSFERRING MEMBER WITH SYMMETRICAL ANGLE PORTIONS

BACKGROUND OF THE INVENTION

1. Field of the Invention

The present invention relates to a heat exchanger and, in particular, to a heat exchanger effectively applied to an air conditioner.

More specially, it relates to a heat exchanger and a heat transfer member, for improving the heat-exchanging performance thereof by producing a turbulent air-flow flowing through a heat-exchanging member thereof, which are preferably applied to, for example, a vehicle.

2. Description of the Related Art

In a conventional heat exchanger, fins have slit pieces, which are segments of the fins and are arranged in a staggered manner in the air flow direction, and the upstream sides, in the air flow, of the slit pieces are bent at around 90 degrees to form bend potions. Due to the bend portions, the air flow around the fins is disturbed so that the thickness of the temperature boundary layer around the fins is prevented from increasing in order to increase the heat transfer coefficient between the fins and air (for example, refer to Patent document 1).

Another heat exchanger has a plurality of pin-shaped (needle-shaped) fins arranged in an air flow and, thereby, the heat exchanging ability of the heat exchanger is improved.

[Patent Document 1]

Japanese Unexamined Patent Publication (Kokai) No. 63-83591

In the invention disclosed in Patent document 1, slit pieces are formed by cutting and raising parts of a thin plate-shaped fin and bend portion are formed by bending upward the front ends (font edges) of the slit pieces, at around 90 degrees. In this configuration, the above-mentioned bend portions have disadvantages, in the manufacturing thereof, as described below.

That is, as in the invention disclosed in Patent document 1, all bend portions are formed by bending the front ends of the slit pieces, the bending force in the same direction is continuously exerted on the thin plate-shaped fin material and, therefore, while the bend portions are formed the fin material is deformed in a state where the repeated deformations of the fin material are accumulated in the same direction, in other words, the fin material is bent in a transverse direction of the fin material, that is, the air flow direction.

The slit pieces should be regularly arranged at a constant pitch but, as described above, in the invention disclosed in Patent document 1 the fin material is likely to be deformed in a state where the repeated deformations of the fin material are accumulated in the same direction, that is, the fin material is bent in a transverse direction of the fin material, that is, the air flow direction. Therefore, it is difficult to reduce the variation of the pitches between the slit pieces. When the variation of the pitches between the slit pieces is increased, the heat transfer coefficient between the fins and air is decreased and, therefore, the desired heat exchanging ability of the fins is unlikely to be obtained.

In a heat exchanger having a plurality of pin-shaped (needles-shaped) fins arranged in the air flow, the weight of the heat exchanger is increased by arranging the fins, that is, a plurality of pins, and the productivity of the fins is deteriorated by arranging a plurality of pins on the heat exchanger. Therefore, it is difficult to realize the mass production thereof.

If a plurality of the pins are formed by cutting the areas between two pins, much material to be scrapped, during cutting, is produced and, therefore, the material is not effectively used. As a result, it is also difficult to realize the mass production thereof.

SUMMARY OF THE INVENTION

The present invention has been developed with the above-mentioned problems being taken into consideration and the primary object of the present invention is to provide a novel heat exchanger differing from the prior art. The secondary objective thereof is to prevent the heat exchanging ability of a heat exchanger from being deteriorated while improving the productivity of the fins by realizing simple shapes of the fins.

Other object of the present invention is to provide a heat exchanger comprising a simple fin shape in order to improve the productivity of the heat exchanger.

Moreover, another object of the present invention is to improve the heat-exchanging performance of a heat exchanger by utilizing a simple fin shape.

To realize the above-mentioned object, in a first aspect of the present invention, a heat exchanger comprises:

tubes (1) in which fluid flows; and fins (2) which are provided on outer surfaces of the tubes (1) and increase a heat exchanging area with air flowing around the tubes (1);

wherein the fin (2) has substantially plate-shaped plane portions (2*a*) and collision walls (2*c*) formed by cutting and raising up parts of the plane portion (2*a*) at an angle of substantially 90 degrees; and wherein groups of a plurality of the collision walls (2*c*) are formed so as to be substantially symmetric with each other in an air flow direction.

Due to this construction, bending forces are continuously exerted on the thin plate-like fin material in the directions in which the bending deformation of the thin plate-like material caused by the bending forces is cancelled when the collision walls (2*c*) are formed. Accordingly, when the collision walls (2*c*) are formed it can be prevented in advance that the fin material is deformed in a state where the repeated deformations of the fin material are accumulated in the same direction, that is, the fin material is bent in a transverse direction of the fin material, that is, the air flow direction.

Therefore, a variation in the size of the collision walls (2*c*) can be reduced.

As a result, while the heat transfer coefficient between air and the fins (2) is increased by the turbulent flow effect caused by the collision walls (2*c*) and also the heat exchanging efficiency is improved, the shape of the fins (2) can be simplified so that the productivity of the fins (2) can be improved.

In a second aspect of the present invention, the collision walls (2*c*) and parts of the plane portion (2*a*) continuously connected to the collision walls (2*c*) form substantially L sectional shapes, and wherein the substantially L sectional shapes on an upstream side of an air flow and the substantially L sectional shapes on a downstream side of the air flow are in a substantially symmetric relationship with each other.

In a third aspect of the present invention, a heat exchanger comprises tubes (1) in which a fluid flows, and fins (2) which are provided on outer surfaces of the tubes (1) and increase the heat exchanging area with air flowing around the tubes (1);

wherein the fin (2) has substantially plate-shaped plane portions (2*a*) and collision walls (2*c*) formed by cutting and raising up parts of the plane portion (2*a*); and wherein, when a ratio (D/C) between a length (C) of the fin (2) orthogonal to the air flow direction and a length (D) of the collision walls (2*c*) orthogonal to the air flow direction is assumed to be a slit length ratio (E), the slit length ratio (E) is set within a range not less than 0.775 and not larger than 0.995.

The present applicant has found that the velocity of the air flowing over the collision walls (2*c*) considerably varies in accordance with the variation of the slit length ratio (E) (see FIGS. 21 to 23 described below). Therefore, in the third aspect of the present invention, by setting the slit length ratio (E) within the above-mentioned suitable range, it is possible to increase the velocity of air flowing over the collision walls (2*c*) within a prescribed range around the maximum air flow velocity (see FIG. 21). As a result, the effect of the improved heat transferring performance of the fin due to the collision walls (2*c*) can be effectively applied.

In a heat exchanger of a fourth aspect of the present invention according to the third aspect thereof, the slit length ratio (E) is set within a range of not less than 0.810 and not larger than 0.980.

Due to this, the heat transferring performance of the fin can be further improved by further increasing the velocity of air flowing over the collision walls (2*c*).

In a heat exchanger of a fifth aspect of the present invention according to any one of the first, third and fourth aspects thereof, the collision walls (2*c*) and slit pieces (2*d*) of the plane portion (2*a*) continuously connected to the collision walls (2*c*) form L-shaped sections, and the L-shaped sections on an upstream side of an air flow and the L-shaped sections on a downstream side of the air flow are arranged substantially symmetrically with each other with respect to a virtual plane perpendicular to the plane portions (2*a*).

In this construction, a preferable aspect of the present invention can be realized by L-shaped sections formed by the collision walls (2*c*) and the slit pieces (2*d*) of the plane portion (2*a*) continuously connected to the collision walls (2*c*).

In a heat exchanger of a sixth aspect of the present invention according to any one of the first to fifth aspects thereof, some of a plurality of the collision walls (2*c*) arranged on the upstream side of the air flow are provided with an angle height (H) higher than that of the other collision walls (2*c*) and all of a plurality of the collision walls (2*c*) arranged on the downstream side of the air flow are provided with an equal angle height (H).

Due to this, the heat transfer coefficient between air and the fins 2 is increased by producing a turbulent flow in the upstream side of the air flow, and the increase of the total pressure loss (air flow resistance) can be prevented by preventing an excessive turbulent flow from being produced in the downstream side of the air flow.

In a heat exchanger of a seventh aspect of the present invention according to any one of the first to sixth aspects thereof, the angle height (H) of some of a plurality of the collision walls (2*c*) arranged on the upstream side of the air flow becomes higher toward a downstream direction of the air flow, and angle height (h) of some of a plurality of the collision walls (2*c*) arranged on the downstream side of the air flow is lower than that (h) of the collision wall (2*c*) arranged on a most downstream side in a plurality of the collision walls (2*c*) arranged on the upstream side of the air flow.

Due to this, the heat transfer coefficient between air and the fins 2 is increased by producing a turbulent flow in the upstream side of the air flow, and the increase of the total pressure loss (air flow resistance) can be prevented by preventing an excessive turbulent flow from being produced in the downstream side of the air flow.

In a heat exchanger of an eighth aspect of the present invention according to any one of the first to seventh aspects thereof, the fins (2) are corrugated fins formed in a wave shape.

In a heat exchanger of a ninth aspect of the present invention according to any one of the first to seventh aspects thereof, the fins (2) are plate fins formed in a plane shape.

In a heat exchanger of a tenth aspect of the present invention according to any one of the first and the third to ninth aspects thereof, a protrusion (2*i*) protruding to an air flow upstream side from an end position of the tube (1) is formed on the fin (2) and the collision walls (2*c*) are also formed on the protrusion (2*i*).

Due to this, a turbulent flow area with a high heat transfer coefficient at a part of the fin (2) which contacts with the wall surface of the tube (1) can be increased (see FIG. 25A described later) and the heat transferring performance of the fin can be effectively improved.

In a heat exchanger of an eleventh aspect of the present invention according to the tenth aspect thereof, at least two of the collision walls (2*c*) are preferably formed on the protrusion (2*i*).

In a heat exchanger of a twelfth aspect of the present invention according to the tenth or the eleventh aspect thereof, a downstream end in an air flow direction of the fin (2) is arranged not to protrude from a downstream end in the air flow direction of the tube (1).

The increase of air flow resistance due to a downstream side end of the fin (2) protruding in an air flowing direction can be prevented and the total performance of the heat exchanger can be effectively ensured.

In a heat transfer member, of a thirteenth aspect of the present invention, made of a thin plate member, dipped in fluid and thereby supplying or receiving the heat between it and the fluid; it comprises angle portions (2*c*) cut and raised up from the thin plate member, and plane portions (2*a*) having a plurality of heat exchanging portions (2*e*) comprising slit pieces (2*d*) continuously connected to root portions of the angle portions (2*c*); and an angle height (H) of the angle portions (2*c*) is not lower than 0.02 mm and is not higher than 0.4 mm, and pitch dimension (P) between the heat exchanging portions (2*e*) adjacent each other in a fluid flowing direction is not lower than 0.02 mm and is not higher than 0.75 mm.

As a result, as shown in FIGS. 8 and 9 described later, the heat exchanging ability of the fins is prevented from being decreased and, at the same time, the shapes of the fins (2) can be simplified so that the productivity of the fins (2) can be improved.

In a heat transfer member, of a fourteenth aspect of the present invention, made of a thin plate member, dipped in fluid and thereby supplying or receiving the heat between it and the fluid; it comprises angle portions (2*c*) cut and raised up from the thin plate member, and plane portions (2*a*) having a plurality of heat exchanging portions (2*e*) comprising slit pieces (2*d*) continuously connected to root portions of the angle portions (2*c*); and an angle height (H) of the angle portions (2*c*) is not lower than 0.06 mm and is not higher than 0.36 mm, and pitch dimension (P) between the heat exchanging portions (2*e*) adjacent each other in a fluid flowing direction is not lower than 0.08 mm and is not higher than 0.68 mm.

As a result, as shown in FIGS. 8 and 9 described later, the heat exchanging ability of the fins is prevented from being decreased and, at the same time, the shapes of the fins (2) can be simplified so that the productivity of the fins (2) can be improved.

In a heat transfer member of a fifteenth aspect of the present invention according to the thirteenth aspect or fourteenth aspect thereof, a raised angle (θ) of the angle portions (2C) is not smaller than 40 degrees and is not larger than 140 degrees.

In a heat transfer member, of a sixteenth aspect of the present invention according to any one of the thirteenth aspect to fifteenth aspect thereof, the angle portions (2*c*) are cut and raised up in a curved shape from the thin plate member.

In a heat transfer member of a seventeenth aspect of the present invention according to any one of the thirteenth to sixteenth aspects thereof, a ratio (H/L) between the angle height (H) and dimension (L) of portions, parallel to the fluid flow direction, of the heat exchange portions (2*e*) is not less than 0.5 and is not more than 2.2.

As a result, as shown in FIG. 12 described later, the heat exchanging ability is prevented from being decreased and, at the same time, the shapes of the fins can be simplified so that the productivity of the fins can be improved.

In a heat transfer member of an eighteenth aspect of the present invention according to any one of the thirteenth to the eighteenth aspect thereof, a relationship between a sectional shape of the heat exchanging portions (2*e*) on an upstream side of a fluid flow and a sectional shape of the heat exchanging portions (2*e*) on a downstream side of the fluid flow is arranged substantially symmetrically with each other.

In a heat transfer member of a nineteenth aspect of the present invention according to any one of the thirteenth to the eighteenth aspect thereof, the heat exchange portions (2*e*) are formed on the plane portions (2*a*) so as to align in a row in the fluid flowing direction.

In a heat transfer member of a twentieth aspect of the present invention according to nineteenth aspect thereof, number of the heat exchanging portions (2*e*) is larger than a value B/0.75 when a value (B) is length of a portion, parallel to the fluid flowing direction, of the plane portions (2*a*) and is expressed in a unit of centimeter.

In a heat transfer member of a twenty first aspect of the present invention according to any one of the thirteenth to the twentieth aspect thereof, at least a flat portion (2*f*) without the angle portion (2*c*) is provided between the heat exchange portions (2*e*) adjacent each other in the fluid flowing direction.

Due to this, the flow resistance of the fluid can be reduced.

In a heat transfer member of a twenty second aspect of the present invention according to the twenty first aspect thereof, dimension (B) of a portion, parallel to a fluid flowing direction, of the plane portions (2*a*) is not smaller than 5 mm and is not larger than 25 mm, and dimension (Cn) of a portion, parallel to the fluid flowing direction, of the flat portions (2*f*) is predetermined and is smaller than 1 mm.

Due to this, the flow resistance of the fluid can be reduced.

In a heat transfer member of a twenty third aspect of the present invention according to the twenty first aspect thereof, dimension (B) of a portion, parallel to a fluid flowing direction, of the plane portions (2*a*) is larger than 25 mm and is not larger than 50 mm, and dimension (Cn) of a portion, parallel to the fluid flowing direction, of the flat portions (2*f*) is not smaller than 1 mm and is not larger than 20 mm.

Due to this, the flow resistance of the fluid can be reduced.

In a heat transfer member of a twenty fourth aspect of the present invention according to any one of the thirteenth to twenty third aspects thereof, when a ratio (D/C) between a length (C) of a thin plate member orthogonal to the fluid flow direction and a length (D) of the angle portions (2*c*) orthogonal to the fluid flow direction is assumed to be a slit length ratio (E), the slit length ratio (E) is set within a range not less than 0.775 and not larger than 0.995.

Due to this, as in the third aspect of the present invention, by setting the slit length ratio (E) within a suitable range, it is possible to increase the velocity of air flowing over the angle portions (2*c*) within a prescribed range near the maximum air flow velocity. As a result, the effect of the improved heat transferring performance of the fin due to the angle portions (2*c*) can be effectively realized.

In a heat transfer member, of a twenty fifth aspect of the present invention, made of a thin plate member, dipped in fluid and thereby supplying or receiving the heat between it and the fluid; it comprises a plane portion (2*a*) having a plurality of heat exchanging portions (2*e*) which comprises angle portions (2*c*) cut and raised up from the thin plate member and slit pieces (2*d*) continuously connected to root portions of the angle portions (2*c*); and when a ratio (D/C) between a length (C) of a thin plate member orthogonal to the fluid flow direction and a length (D) of the angle portions (2*c*) orthogonal to the fluid flow direction is assumed to be a slit length ratio (E), the slit length ratio (E) is set within a range not less than 0.775 and not larger than 0.995.

Due to this, as in the twenty fourth aspect of the present invention, by setting the slit length ratio (E) within a suitable range, it is possible that the effect of the improved heat transferring performance of the fin due to the angle portions (2*c*) can be effectively realized.

In a heat transfer member of a twenty sixth aspect of the present invention according to the twenty fourth or twenty fifth aspect thereof, the slit length ratio (E) is set within a range not less than 0.810 and not larger than 0.980. Therefore, the velocity of air flowing over the angle portions (2*c*) is further increased and the heat transferring performance of the fin can be further improved.

The term "symmetric" in the first, fifth and eighteenth aspects is used in such a case where the collision walls (2*c*), the L-like sectional shape including the collision walls (2*c*) or the heat exchanging portions (2*e*) including the angle portions (2*c*) are arranged basically in a symmetrical state with respect to the air (fluid) flow direction, but it is also used, as described later in the description of the embodiments, in cases such as a case including a small portion having an unsymmetrical shape and a case in which the number of the collision walls (2*c*), the angle portions (2*c*) or the heat exchanging portions (2*e*) in the upstream side of the air (fluid) flow is different from that in the downstream side thereof, in a small amount, or the like.

In other words, the term "symmetric" is not limited to a completely symmetrical case, but is used to include the substantially symmetrical case (substantially symmetric) in which the fin material is prevented from being concentrated in a certain area, during fin forming.

The symbols in the brackets attached to each means are examples for showing the correspondence with the specific means described in the later embodiments.

The present invention may be more fully understood from the description of the preferred embodiments of the invention set forth below, together with the accompanying drawings.

DESCRIPTION OF THE PREFERRED EMBODIMENTS (First Embodiment)

Figure 1:
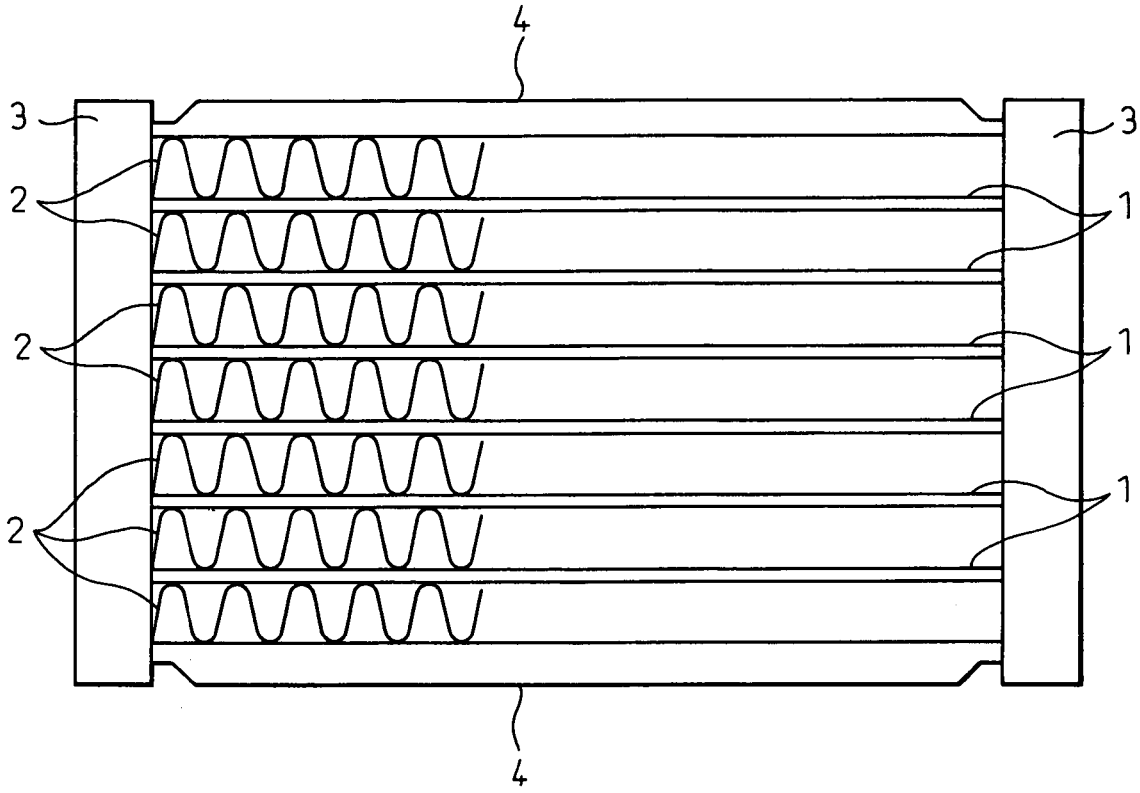
FIG. 1 is a front view of a heat exchanger according to embodiments of the present invention.
Figure 2A:
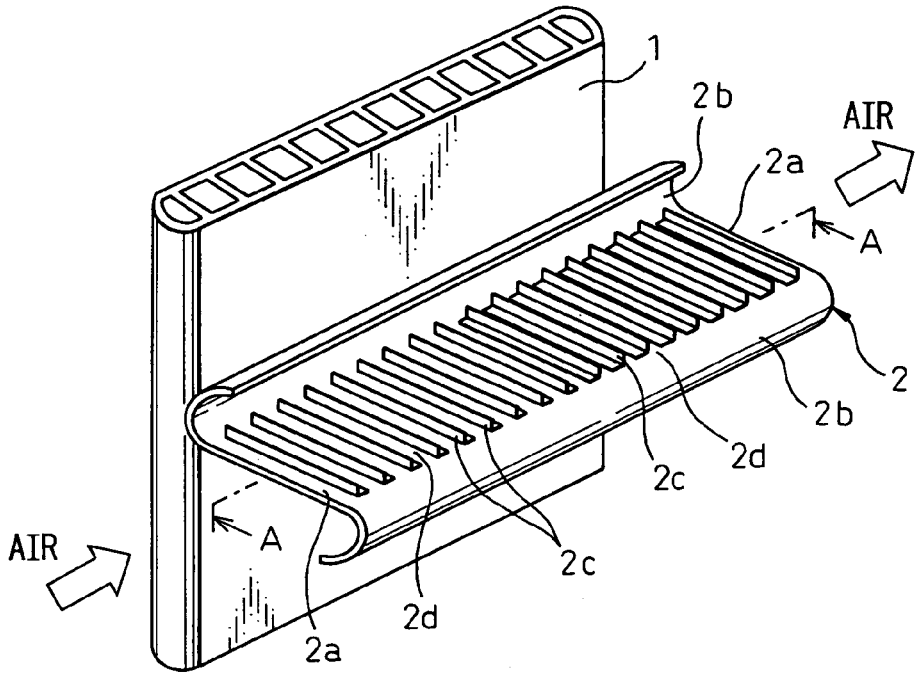
FIG. 2A is a perspective drawing of major components of a heat exchanger according to a first embodiment of the present invention.
Figure 2B:
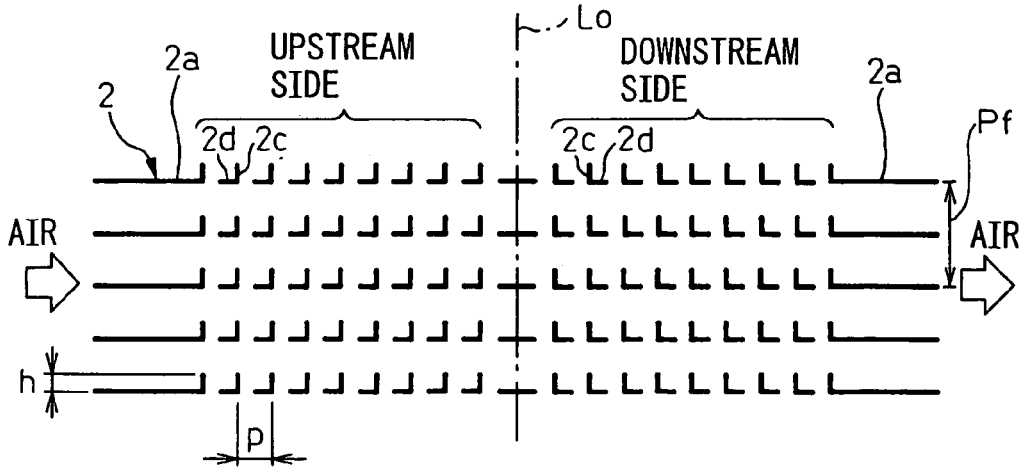
FIG. 2B is a sectional view taken along a line A—A in FIG. 2A.

In the present embodiment, a heat exchanger according to the present invention is applied to a heat radiator of an air conditioner for a vehicle. FIG. 1 is a front view of the heat exchanger, i.e. the heat radiator, according to the present embodiment and FIG. 2A is a perspective drawing showing major components of the heat exchanger according to the present embodiment and FIG. 2B is a sectional view taken along a line A—A in FIG. 2A. In FIG. 1 an air flows in a vertical direction of the drawing.

Particularly, the heat radiator is a heat exchanger provided on a high pressure side of a vapor compression type refrigerating apparatus for cooling a refrigerant by dissipating the heat of the refrigerant discharged from a compressor. When a discharge pressure is lower than the critical pressure of the refrigerant, the refrigerant in the heat radiator is condensed and, at the same time, dissipates the heat absorbed by an evaporator, and when the discharge pressure is not lower than the critical pressure of the refrigerant the refrigerant in the heat radiator is not condensed and dissipates the heat absorbed by the evaporator and, as a result, the temperature of the refrigerant is reduced.

In detail, the heat radiator comprises a plurality of tubes 1 through which the refrigerant flows, fins 2 attached on the outer surface of the tube 1 and increasing the heat transfer area exchanging the heat with air so as to facilitate the heat exchange between refrigerant and air, header tanks 3 extending in the direction perpendicular to the longitudinal direction of the tubes 1 at the both longitudinal ends of the tubes 1 and being communicated with each end of tubes 1, inserts 4 acting as a reinforcement for a core portion including tubes 1, fins 2 and the like, as shown in FIG. 1.

In this embodiment, the tubes 1, fins 2, header tanks 3, and inserts 4 are all made of a metal (for example, aluminum alloy) and are joined each other by soldering.

By the way, the tube 1 has a flat shape, has a plurality of holes, and is provided with a plurality of refrigerant passages inside, as shown in FIG. 2A, by extruding or withdrawing a metal material, and the fins 2 are attached on the flat portions of the tube 1 by soldering.

The fin 2 is a corrugated fin formed as a wave and has bend portions 2*b* which are bent to connect adjacent plane portions 2*a* which have substantially flat plate shapes and are arranged side by side. In this embodiment, the corrugated fins 2 having a wave-like shape are formed by performing roller forming on a thin metallic plate material. The bend portions 2*b* of the fin 2 are brazed to the flat portion (plane portion) of the tube 1.

The plane portion 2*a* of the fin 2 is then provided with a plurality of angle portions 2*c* which are formed by raising up parts of the plane portion 2*a* at a substantially right angle.

To cut and to raise up parts at substantially 90 degrees means that, in practice, parts of the plane portion 2*a* are cut and raised up at substantially 90 degrees with respect to the surface of the plane portion 2*a*. The raised angle of the angle portions 2*c* may be increased or decreased by a small degree and, therefore, may be around 90 degrees.

The angle portions 2*c* are impinged by air flowing over the surface of the fin 2, i.e. the plane portion 2*a*, so as to disturb the air flow over the plane portion 2*a*. Due to this construction, the heat transfer coefficient between the fin 2 and the air is increased.

Therefore, the angle portions 2*c* function as collision walls against an air flow. A flat plate-like portion, connecting to a root portion of the angle portion 2*c*, of the plane portion 2*a* of the fin 2 is referred as a slip piece 2*d*. The slip pieces 2*d* and the angle portions 2*c* form an L-shaped section.

Concretely, when the plane portion 2*a* is divided, in the air flow direction, into two equal parts, i.e. the upstream side and the downstream side by the virtual plane $L_0$, the number of the angle portions 2*c* on the upstream side and that on the downstream side are substantially same and, at the same time, the angle portions 2*c* at the upstream side of the air flow are made by raising up the air-flow downstream parts of the slit pieces 2*d* at substantially 90 degrees and the angle portions 2*c* on the air-flow downstream side are made by raising up the upstream parts of the slit pieces 2*d* at substantially 90 degrees.

Next, the manufacturing method of the fins 2 will be generally described below.

Figure 3:
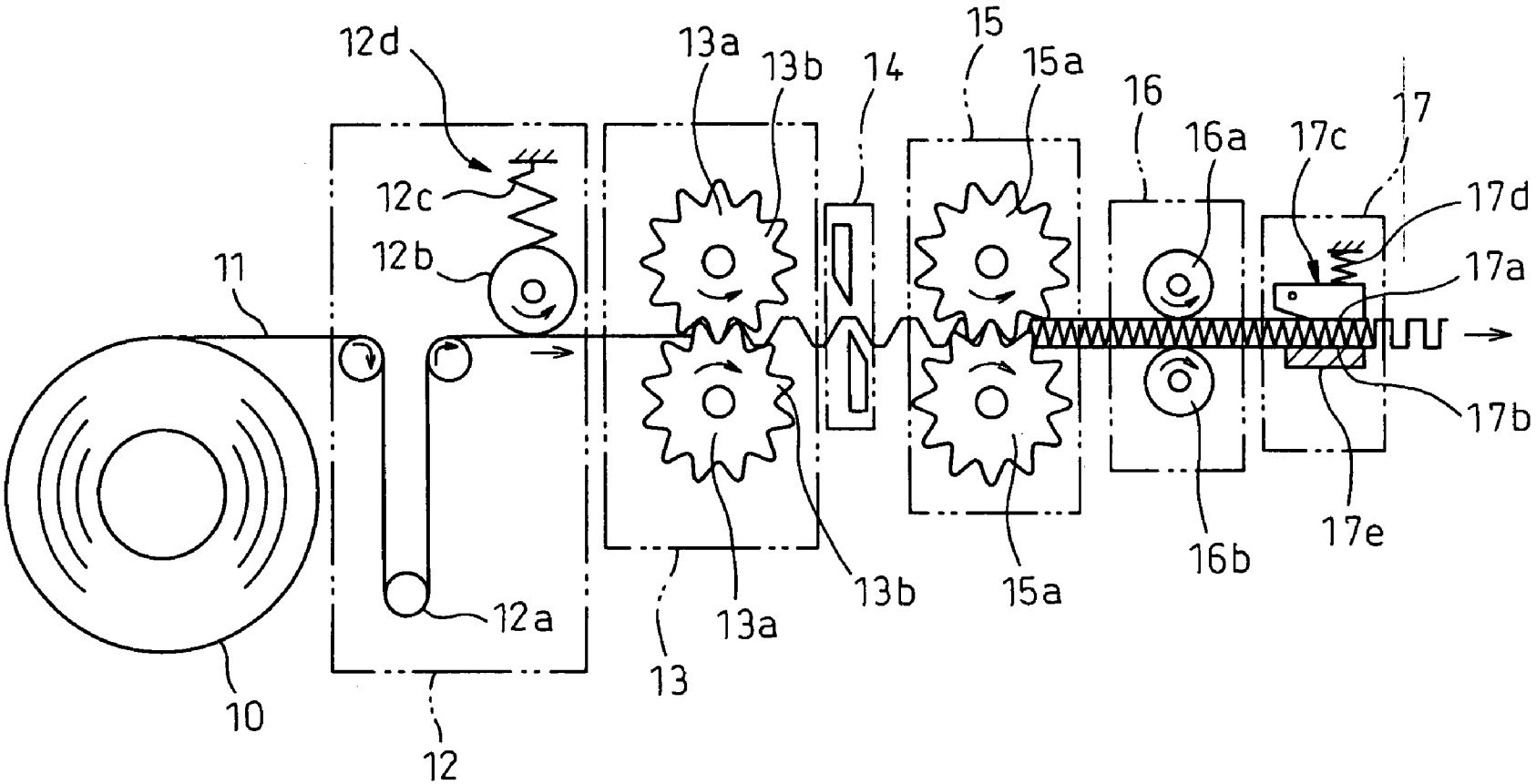
FIG. 3 is an exemplary drawing of a roller forming apparatus.

FIG. 3 is an exemplary drawing of a roller forming device. In the drawing, a thin plate-like fin material 11 withdrawn from a roll material (un-coiler) 10 is pulled with a specific tension by a tension machine 12 which exerts a predetermined tension force on the fin material 11.

The tension machine 12 comprises a weight tension section 12*a* exerting a constant tension force using gravity on the fin material 11 and a roller tension section 12*d*, which includes a roller 12*b* rotating in accordance with the advance of the fin material 11 and a spring means 12*c* exerting a predetermined tension force on the fin material 11 via the roller 12*b*.

The predetermined tension force is exerted on the fin material 11 by the tension machine 12 so that the fin height of each of the fins which are bent and formed into angle shapes by a fin forming machine 13 described later is maintained at a constant height.

The fin forming machine 13 bends the fin material 11, on which the predetermined tension force is exerted by the tension machine 12, to form a plurality of the bend portions 2*b* (FIGS. 2A and 2B) and to make the fin material 11 into a wave shape and, at the same time, forms the angle portions 2*c* on the area corresponding to the plane portion 2*a*.

The fin forming machine 13 comprises a pair of gear-like forming rollers 13*a* and cutters which are provided on teeth surfaces of the forming rollers 13*a* and form the angle portions 2*c*. When the fin material 11 passes through a space between the forming rollers 13*a*, the fin material 11 is bent so as to contact the teeth portions 13*b* of the forming rollers 13*a* and to be formed into a wave shape and, at the same time, the angle portions 2*c* are formed thereon.

A cutting machine 14 cuts the fin material 11 into a predetermined length so that the bend portions 2*b* in a predetermined number are formed on the fin 2. The fin material 11 cut into the predetermined length is sent toward a curing device 16 described later by a transfer device 15.

The distance between the adjacent bent portions 2*b* of the corrugated fin 2 formed in a wave shape by bending is generally denoted as a fin pitch Pf. The fin pitch Pf, as shown in FIG. 2B as a sectional view of the fin, is twice the distance between the adjacent plane portions 2*a*.

In detail, the fin pitch (Pf) of the completed fin 2 (the distance between the adjacent bend portions 2*b*) is small when the pressure angle of the forming rollers 13*a* is increased. The fin pitch (Pf) of the completed fin 2 is large when the pressure angle of the forming rollers 13*a* is decreased. In this case, if the difference between the module of the forming rollers 13*a* and that of the transfer rollers 15*a* is within 10%, the fins can be formed without replacing the transfer rollers 15*a*.

The curing device 16 cures the undulation of the bend portions 2*b* by pressing the bend portions 2*b* from the direction substantially perpendicular to the ridge direction of the bend portions 2*b*. The curing device 16 comprises a pair of curing rollers 16*a*, 16*b* sandwiching the fin material 11 and is rotated dependent on the movement of the fin material 11 when it advances. The curing rollers 16*a*, 16*b* are arranged so that a line connecting the rotational centers of the curing rollers 16*a*, 16*b* is perpendicular to the advancing direction of the fin material 11.

A brake device 17 comprises brake surfaces 17*a*, 17*b* coming into contact with a plurality of the bending portions 2*b* and for generating a friction force in the opposite direction of the advancing direction of the fin material 11. The brake device 17 which is located more downstream, in the advancing direction of the fin material 11, than the curing device 16 presses and contracts the fin material 11 by transferring a force generated by the transfer device 15 and by a friction force generated at the brake surfaces 17*a*, 17*b*, so that the bend portions 2*b* of the fin material 11 come into contact with each other.

A brake shoe 17*c* provided with the brake surface 17*a* is rotatably supported at one end of the brake shoe 17*c* and a spring member 17*d* acting as a friction force adjusting mechanism is located on the other end thereof. The friction force generated at the brake surfaces 17*a*, 17*b* is adjusted by adjusting the deflection of the spring member 17*d*. The brake shoe 17*c* and a plate portion 17*e* forming the brake surface 17*b* are made of an abrasion-proof material, such as a die steel.

Next, the operation of the roller forming device for forming the fins according to the present embodiment is described in accordance with the step order of the process performed in the roller forming device.

The fin material 11 is withdrawn from the material roll 10 (withdrawal process), the withdrawn fin material is given with the predetermined tension force in the advancing direction of the fin material 11 (tension generating process). Then, the bend portions 2*b* and the angle portions 2*c* are formed on the fin material 11 by the fin forming machine 13 (fin forming process), and the fin material 11 is cut into the predetermined length by the cutting machine 14 (cutting process).

Next, the fin material 11, cut into the predetermined length, is transferred to the curing device 16 by the transfer device 15 (transferring process). The bend portions 2*b* are then pressed by the curing device 16 so that the undulation of the fin material 11 is cured (curing process) and, at the same time, the fin material 11 is contracted by the brake device 17 so that the adjacent bend portions 2*b* come into contact with each other (contracting process).

Further, the fin material 11 having experienced the contracting process is expanded due to the its elasticity and is formed to have the predetermined fin pitch (Pf). Then inspection processes, such as a dimension inspection process, are performed and the forming of the corrugate fins is terminated.

Next, the effects and functions of the present embodiment will be described below.

In the present embodiment, as groups of a plurality of the angle portions 2*c* are provided so as to be substantially symmetric with each other in the air flow direction, bending forces are continuously exerted on the thin plate-like fin material 11, in a direction where the bending deformation of the thin plate-like fin material 11 is cancelled, during the fin forming process. Accordingly, when the angle portions 2*c* are formed it can be prevented in advance that the fin material 11 is deformed in a state where the repeated deformations of the fin material 11 are accumulated in the same direction, in other words, the fin material 11 is bent in a transverse direction of the fin material 11, that is, the air flow direction. Therefore, the variations in the shapes, sizes and the like of the slit pieces 2*d* and the angle portions 2*c* can be reduced.

As a result, while the heat transfer coefficient between air and the fins 2 is increased by the turbulent flow effect caused by the angle portions 2*c* and also the heat exchanging efficiency is improved, the shape of the fins 2 can be simplified so that the productivity of the fins 2 can be improved.

According to a study by the present applicant, it is preferable that the thickness of each fin 2 is set to between 0.01 and 0.1 mm, the height h of each angle portion (refer to FIG. 2B) to between 0.1 and 0.5 mm, and the pitch dimension p between the angle portions 2*c* (refer to FIG. 2B) is set to between 1.5 and 5 times the angle height h of the angle portions 2*c*. In the present embodiment, the thickness of each fin 2 is set to 0.05 mm, the height h of each angle portion to 0.2 mm, and the pitch dimension p between the angle portions 2*c* to 2.5 times the angle height h of the angle portions.

The angle height H is a height of the angle portion including the thickness of the fin 2, as clearly shown in FIGS. 7, 14 and 15 described later.

(Second Embodiment)

Figure 4:
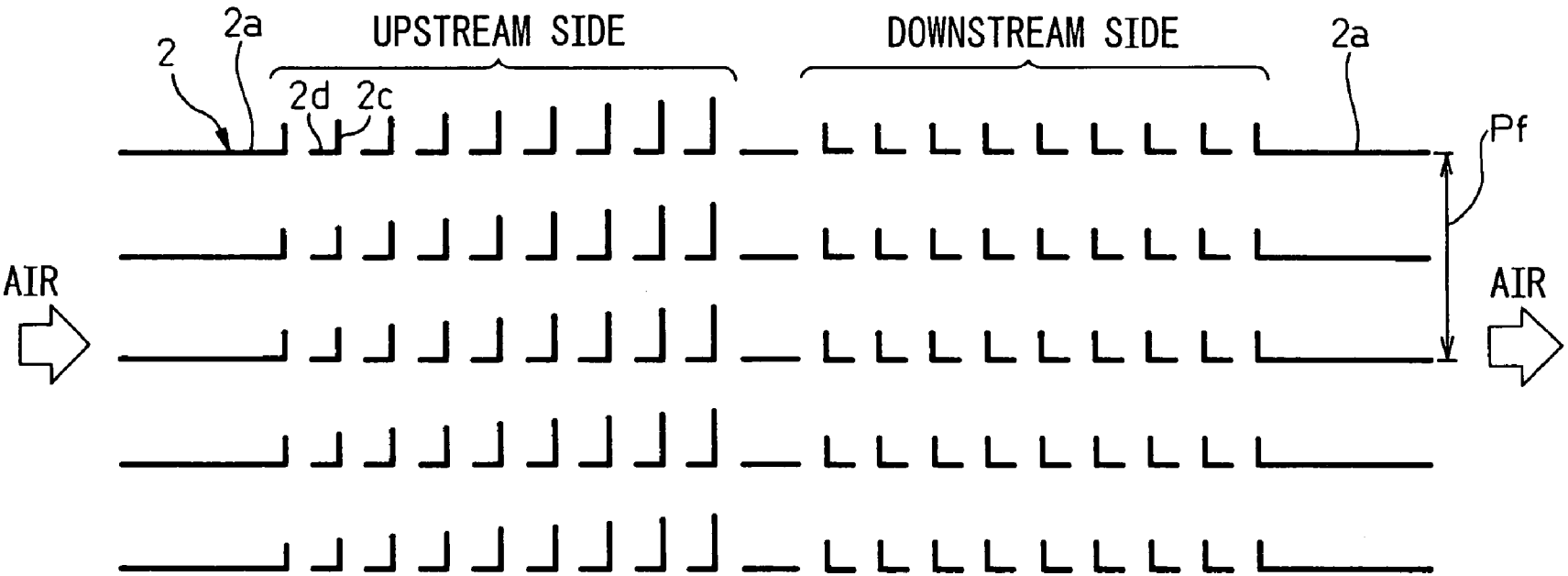
FIG. 4 is a sectional view showing a fin according to a second embodiment of the present invention.

In a second embodiment, as shown in FIG. 4, the angle heights h of a plurality of the angle portions 2*c* located on the upstream side of the air flow are gradually varied so as to increase toward the downstream direction of the air flow. On the other hand, all the angle heights h of a plurality of the angle portions 2*c* located at the downstream side of the air flow are identical, are predetermined, and are lower than the lowest angle height h of the angle portion 2*c* located at the most downstream side in a plurality of the angle portions 2*c* located at the upstream side of the air flow.

Due to this, all the angle heights h of a plurality of the angle portions 2*c* located at the upstream side of the air flow are higher than those of the other angle portions 2*c* and, therefore, the heat transfer coefficient between air and the fins 2 is increased by producing a turbulent flow in the upstream side of the air flow, and the increase of the total pressure loss (air flow resistance) is prevented by preventing an excessive turbulent flow in the downstream side of the air flow.

Even if the effect of the turbulent flow might be increased by increasing the height of the angle portions at the downstream side in the air flow, as the fins 2 on the downstream side cannot effectively serve for heat exchanging and the pressure loss (air flow resistance) is increased, the exchanged heat is decreased.

In the second embodiment, as the angle heights H of a plurality of the angle portions 2*c* arranged on the upstream side of the air flow are gradually increased towards the downstream direction of the air flow, the group of the angle portions 2*c* arranged on the upstream side of the air flow are not completely symmetrical to the group of the angle portions 2*c* arranged on the downstream side of the air flow but both groups of the angle portions 2*c* have L-shaped sections which are a common feature and the L-shaped sections of the groups are substantially symmetrical. Therefore, the arrangement of the angle portions 2*c* according to the second embodiment has a substantially symmetrical relationship defined in the present invention.

In the first and second embodiments, the number of the angle portions 2*c* on the upstream side of the air flow is set to the same (each 9) as that on the downstream side of the air flow, but even if the numbers are different from each other by small amount, such as one, the relationship of the both groups of the angle portions 2*c* is included in the "substantially symmetrical relationship" defined in the present invention.

(Third Embodiment)

Figure 5:
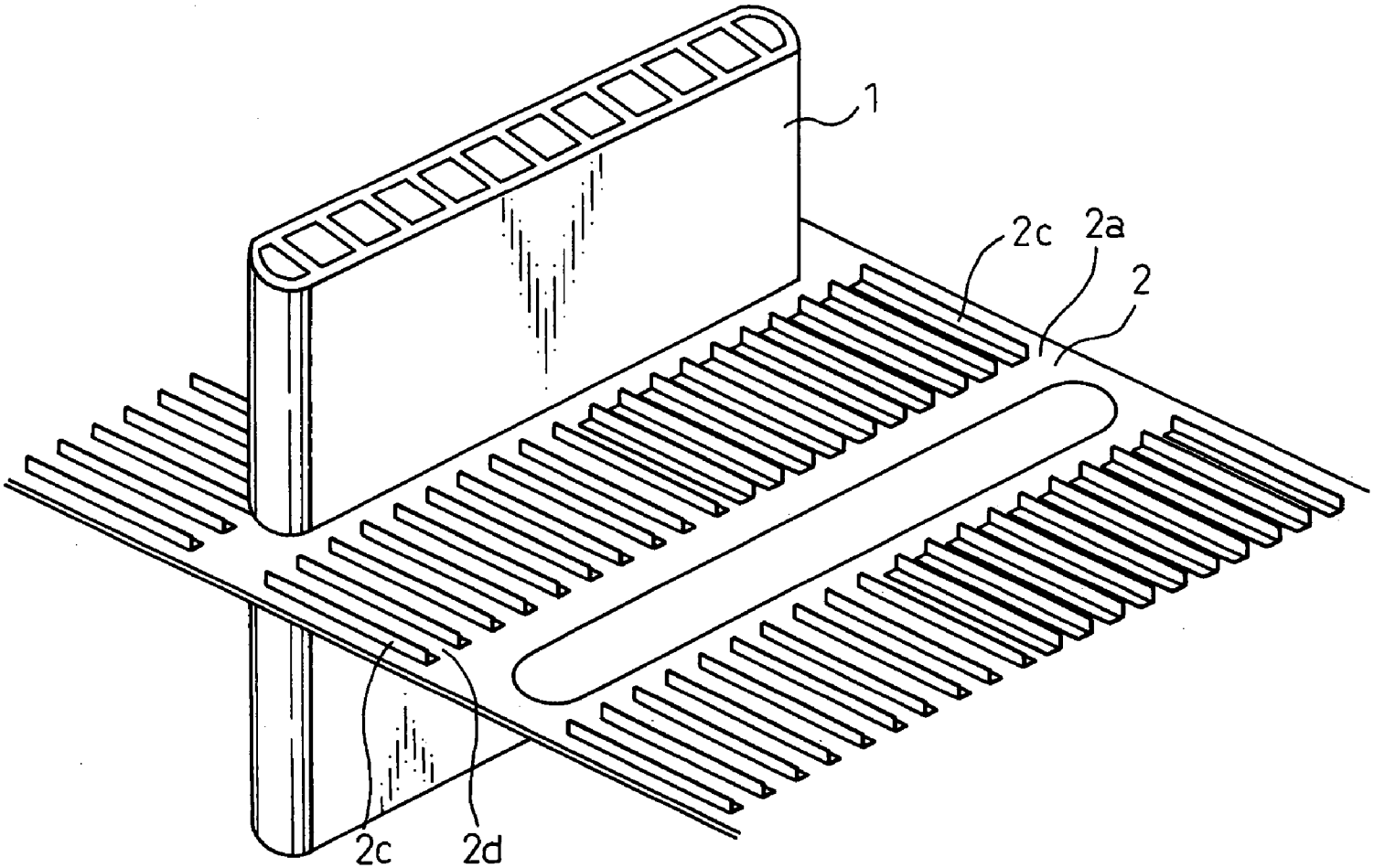
FIG. 5 is a perspective drawing of major components of a heat exchanger according to a third embodiment of the present invention.

In the first and second embodiments described above, heat exchangers comprising the corrugated fins 2 formed in a wave shape by bending are disclosed. On the other hand, in a third embodiment, the present invention is applied to a heat exchangers comprising plate-like fins 2 formed in plate-like shapes, as shown in FIG. 5.

(Fourth Embodiment)

In the embodiments described above, one group of the angle portions 2*c* on the upstream side and the other group of the angle portions 2*c* on the downstream side are symmetrical with each other with respect to the virtual plane L0. On the other hand, in a fourth embodiment, one group of the angle portions 2*c* on the upstream side of an air flow and the other group of the angle portions 2*c* on the downstream side of the air flow are symmetrical with each other with respect to the plate portion 2*a*, in an example such as shown in FIG. 6A, or groups each of which is formed by a pair of the angle portions 2*c*, which are symmetrical with each other, are aligned in the air flow direction, in examples as shown in FIGS. 6B and 6C.

Figures 6A, 6B, 6C, 6D:
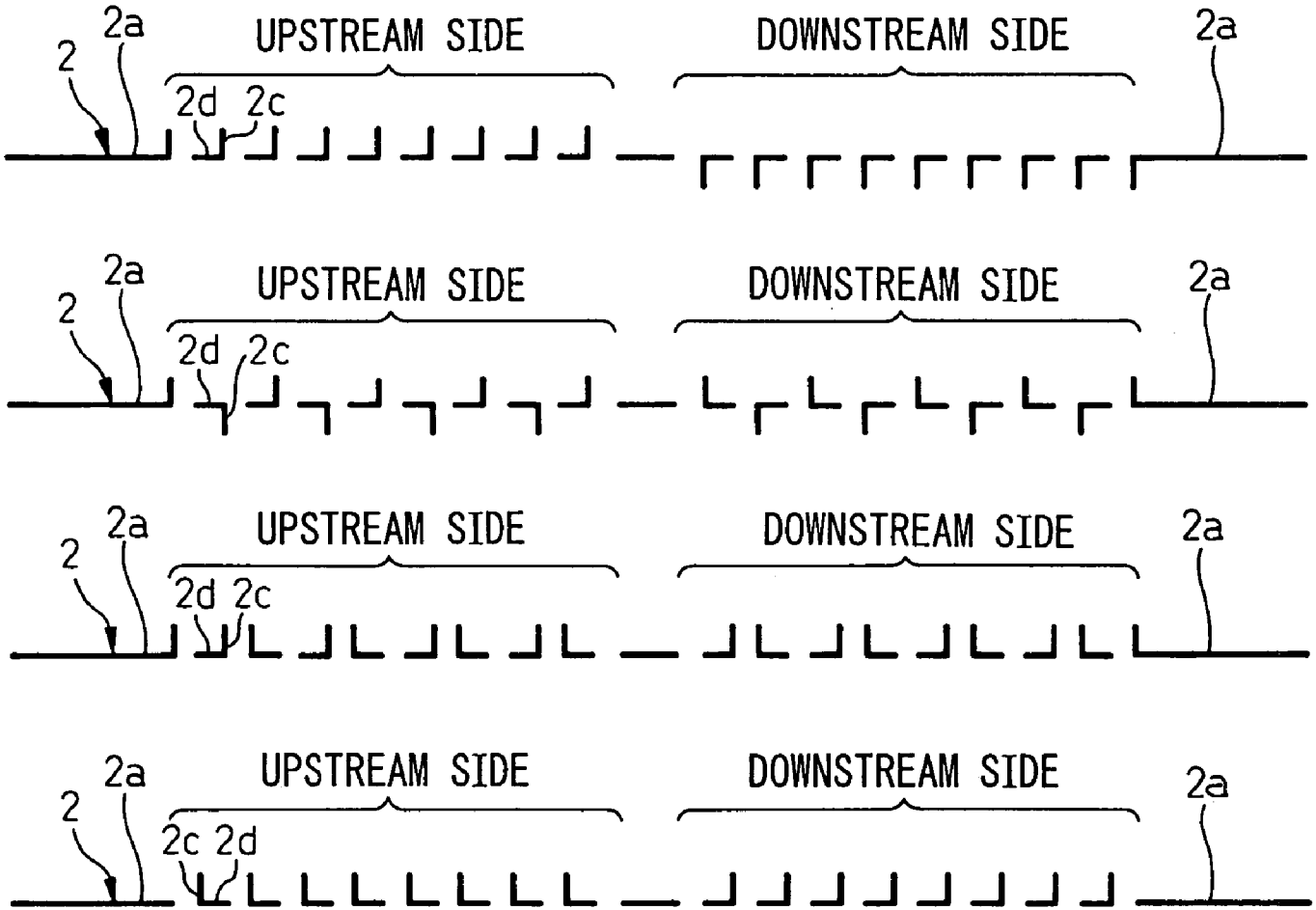
FIG. 6A is a sectional view showing a fin arrangement according to a fourth embodiment of the present invention.
FIG. 6B is a sectional view showing another fin arrangement according to a fourth embodiment of the present invention.
FIG. 6C is a sectional view showing another fin arrangement according to a fourth embodiment of the present invention.
FIG. 6D is a sectional view showing another fin arrangement according to a fourth embodiment of the present invention.

Alternatively, in an example as shown in FIG. 6D, the position of each angle portion 2*c* with respect to the slit piece 2*d* is opposite to that in the first embodiment. Any one of the arrangements shown in FIGS. 6A, 6B, 6C and 6D and the arrangement of the second embodiment (shown in FIG. 4) may, of course, be combined.

(Fifth Embodiment)

Figure 7:
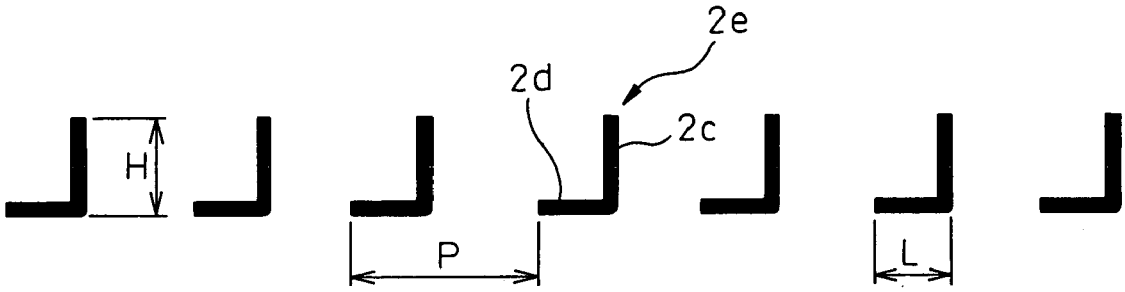
FIG. 7 is a sectional view of fins showing the definitions of angle height H and pitch dimension P between heat exchanging portions 2*e*.

FIG. 7 shows a sectional view of the fin for illustrating a fifth embodiment and the angle height H of the angle portions 2*c* is set to 0.02 mm or higher and 0.4 mm or lower and, at the same time, the pitch dimension P between the heat exchanging portions 2*e* composed of the angle portions 2*c* and the slit pieces 2*d* which are continuously connected to the root portions of the angle portions 2*c* is set to 0.02 mm or larger and 0.75 mm or smaller.

As shown in FIG. 7, the pitch dimension P between the heat exchanging portions 2*e* is the dimension representing a distance between the adjacent heat exchanging portions 2*e* adjacent in the air flow direction and the angle height H is equal to the dimension of a part, of the heat exchanging portion 2*e*, parallel to the direction perpendicular to the air flow direction.

Figure 8:
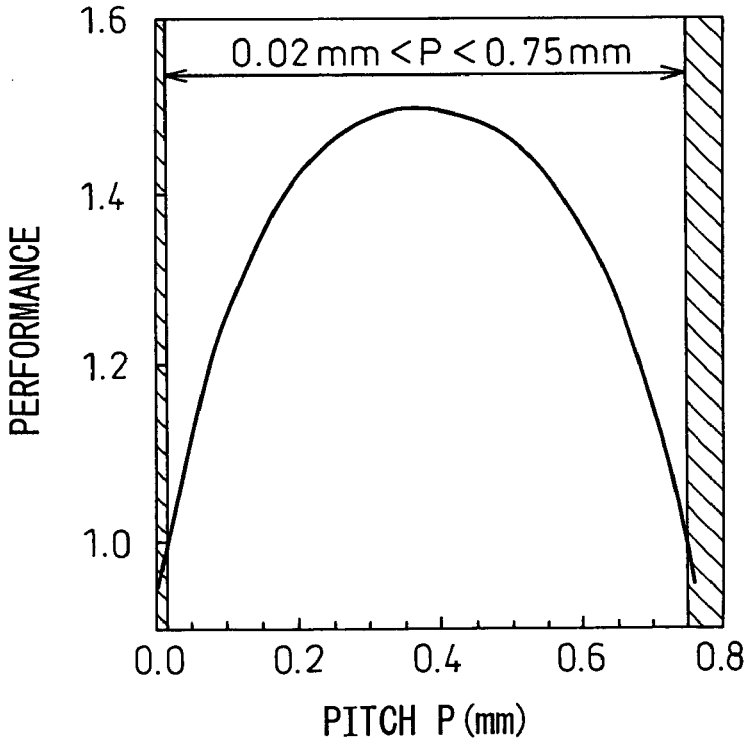
FIG. 8 is a graph of a numeral simulation result showing the relationship of the pitch dimension P between the heat exchanging portions 2*e* with respect to the heat exchanging performance.
Figure 9:
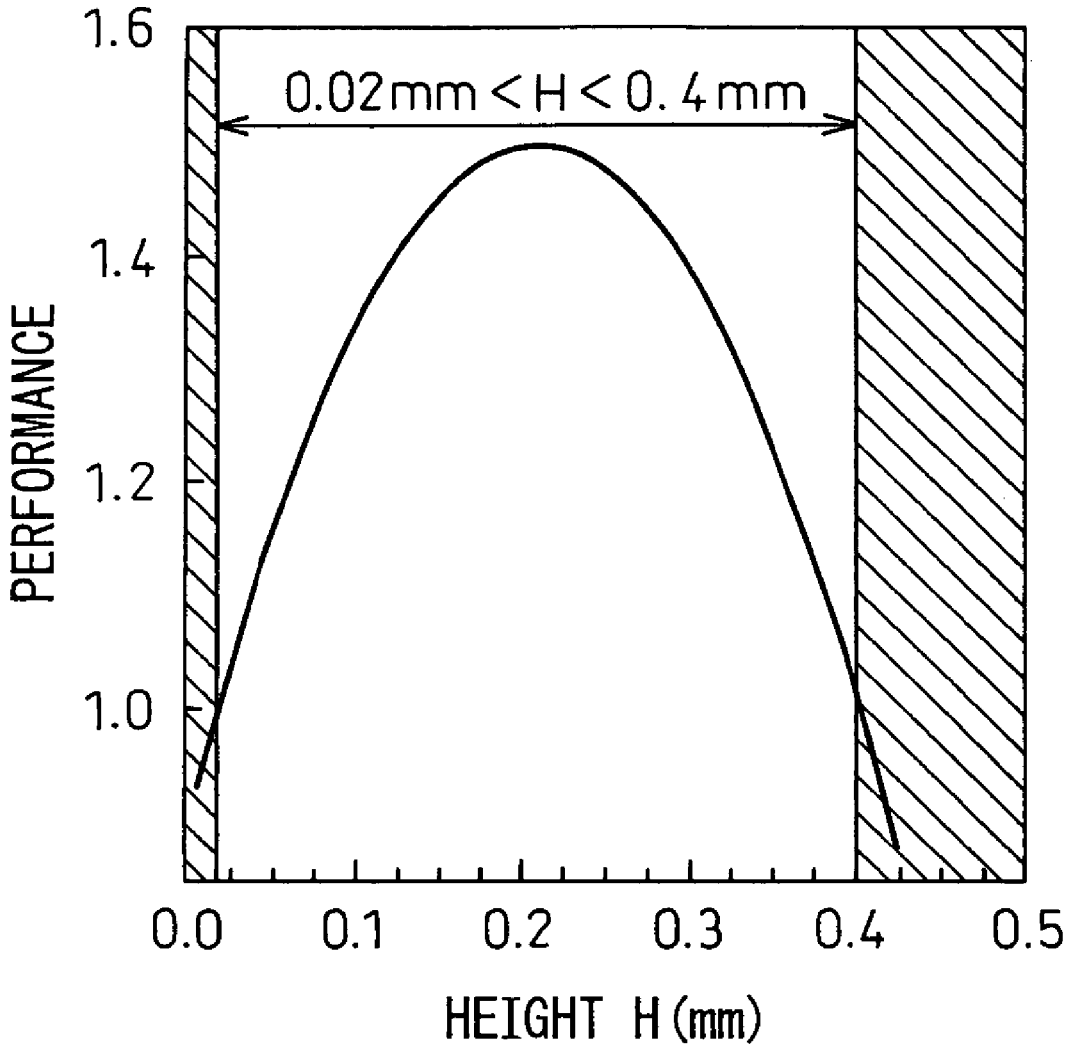
FIG. 9 is a graph of a numeral simulation result showing the relationship of the angle height H with respect to the heat exchanging performance.

FIG. 8 shows the numerical simulation result representing a relationship between the pitch dimension P of the heat exchanging portions 2*e* and the heat exchanging ability of the fins and FIG. 9 shows the numerical simulation result representing a relationship between the angle height H of the angle portions 2*c* and the heat exchanging ability. As is clear from FIG. 8 and FIG. 9 in the case where the angle height H is set to 0.02 mm or higher and 0.4 mm or lower and, at the same time, the pitch dimension P of the heat exchanging portions 2*e* is set to 0.02 mm or larger and 0.75 mm or smaller, the heat exchanging ability is improved.

The heat exchanging ability is determined based on the multiplication of the heat transfer coefficient and the heat transfer area. In FIGS. 8 and 9, the variations of the ratios of the heat exchanging ability of the fins of the present invention against that of fins of a conventional heat exchanger, in which a louver is installed and which is used as a reference, is indicated in accordance with the variations of the pitch dimension P and the angle height H, respectively.

When the angle height H of the angle portions 2*c* or the pitch (pitch dimension) P between the heat exchanging portions 2*e* is varied, the pressure loss (air flow resistance) of the air flowing around the fin 2, i.e. the plane portion 2*a*, is also varied and therefore in the numerical simulation, as shown in FIGS. 8 and 9, the heat exchanging ability is calculated by varying the angle height H of the angle portions 2*c* and the pitch P between the heat exchanging portions 2*e*, so that the pressure loss (air flow resistance) becomes substantially equal by varying a fin pitch Pf which is twice of the distance between the adjacent plate portions 2*a* (see FIGS. 2B and 4), in accordance with the variation of the height H of the angle portions 2*c* or the pitch P between the heat exchanging portions 2*e*.

Figure 10:
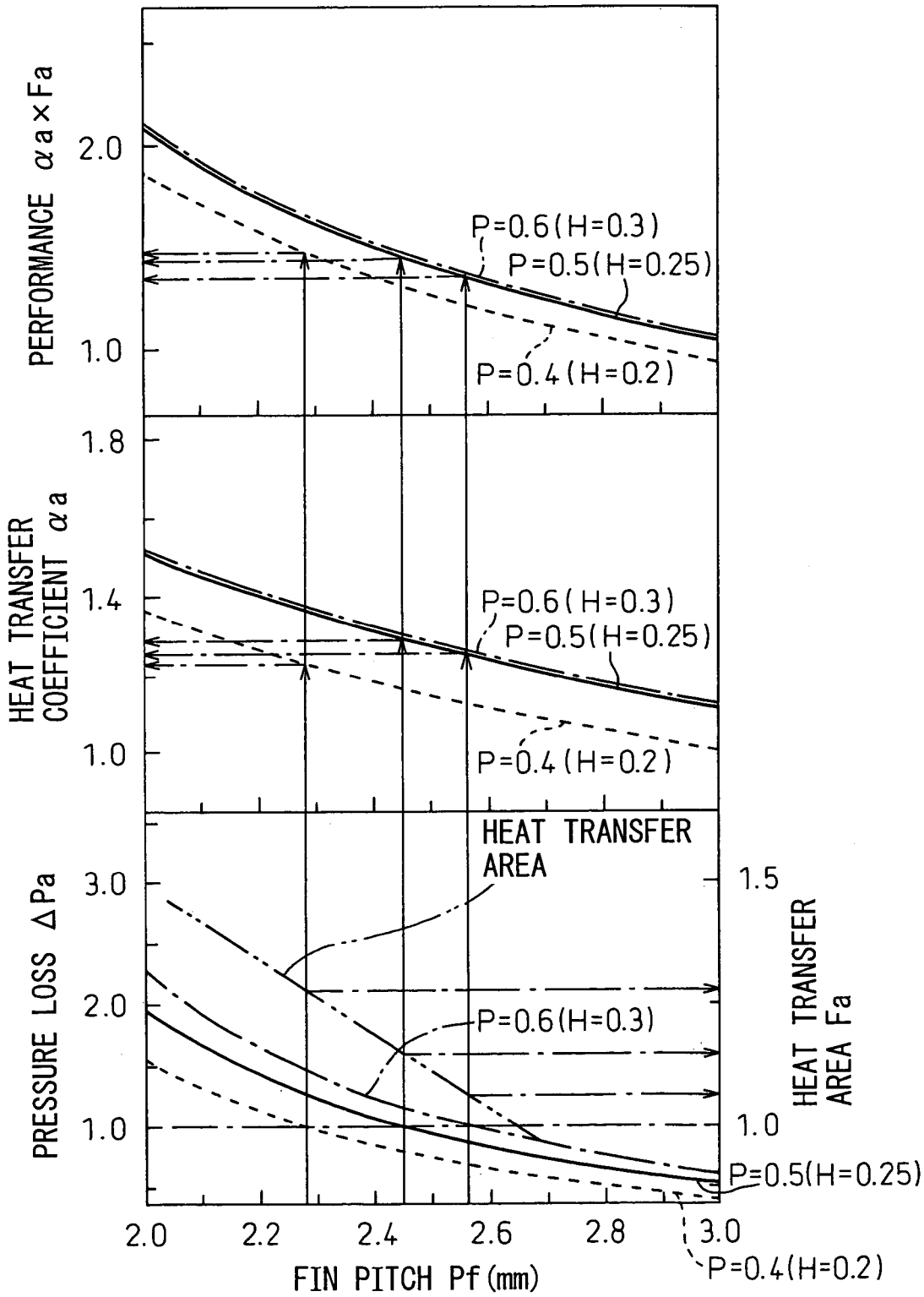
FIG. 10 is a graph of a numeral simulation result using the pitch dimension P between the heat exchanging portions 2*e* as a parameter.
Figure 11:
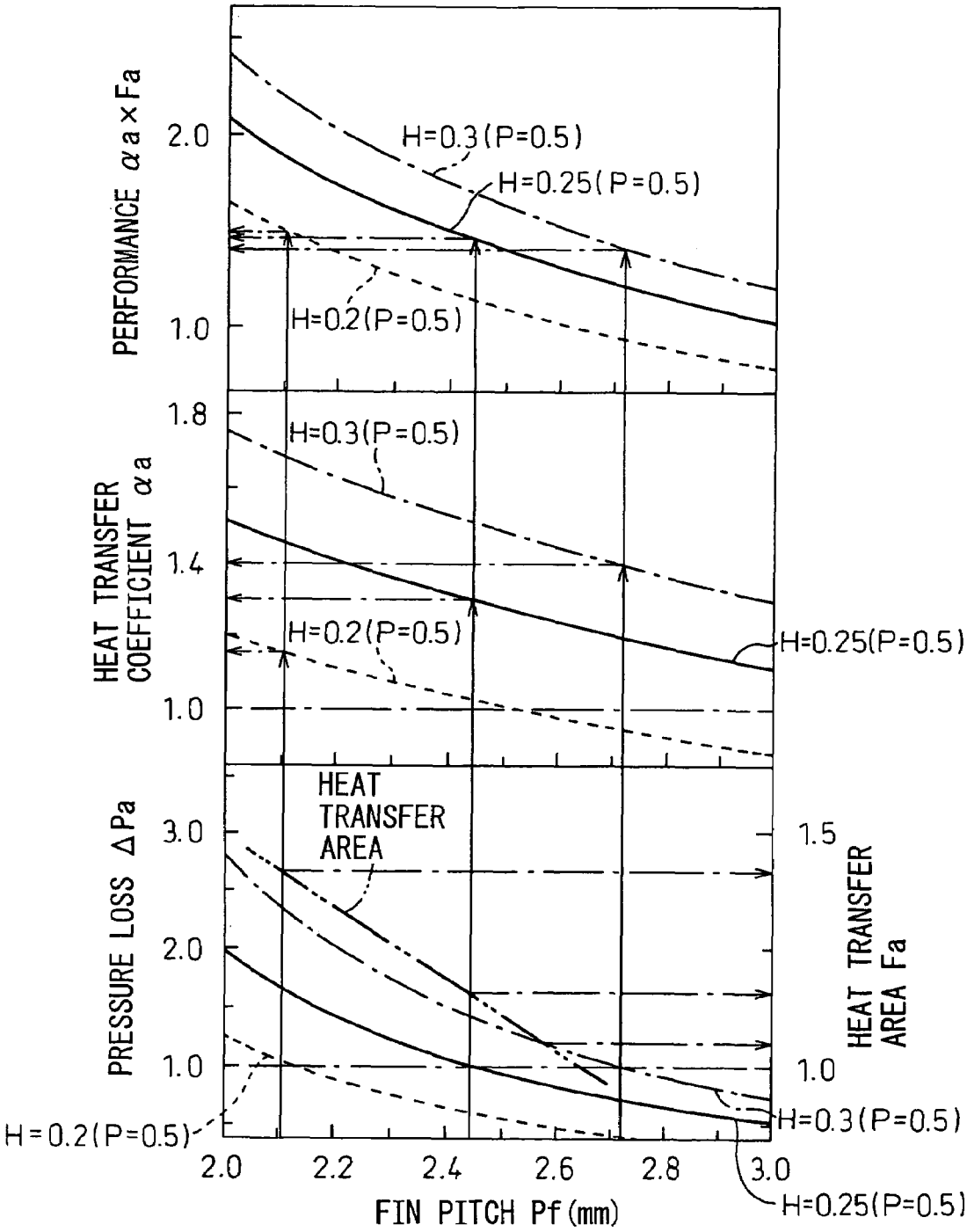
FIG. 11 is a graph of a numeral simulation result using the angle height H of the angle portions 2*c* as a parameter.

In detail, if the fin pitch is increased, the air flow resistance is reduced, as shown in FIGS. 10 and 11, whereas the number of the plane portions 2*a* is decreased, so that the heat transfer (exchanging) area and the heat transfer coefficient are decreased. In contrast, if the fin pitch is decreased, the number of the plane portions 2*a* is increased, so that the heat transfer area and the heat transfer coefficient are increased, whereas the air flow resistance is increased.

FIG. 10 shows the result of the numerical simulation test in which the pitch P between the heat exchanging portions 2*e* is used as a parameter and FIG. 11 shows the result of the numerical simulation test in which the angle height H of the angle portions 2*c* is used as a parameter.

As the angle portions 2*c* are cut and raised up from the plane portion 2*a*, the dimension L (refer to FIG. 7) of a part, of the heat exchanging portion 2*e*, parallel to the air flow direction varies in accordance with the height H of the angle portions 2*c* and the pitch P between the heat exchanging portions 2*e*.

Figure 12:
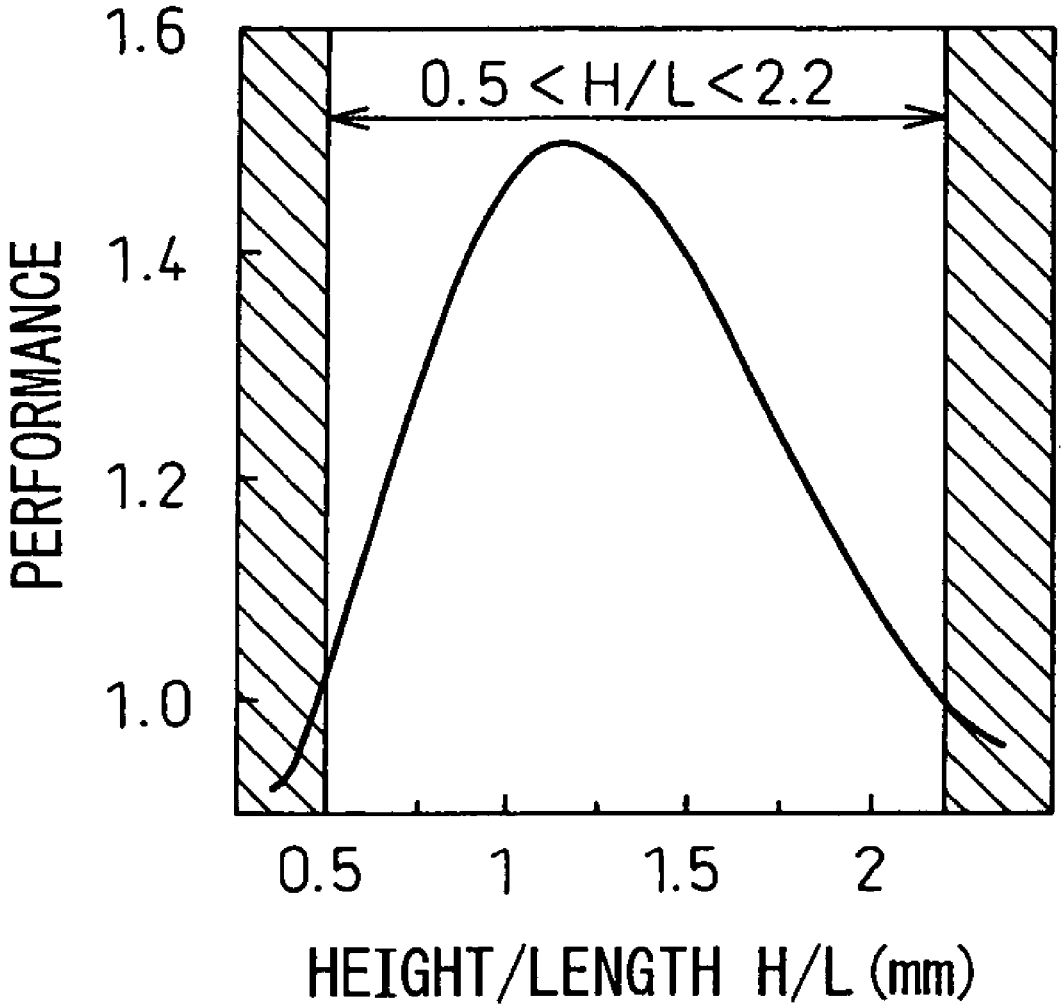
FIG. 12 is a graph including a summary relationship between the ratio (H/L) and the heat exchanging performance, wherein the ratio (H/L) is specified by the ratio of the dimension H of a portion, parallel to the air flowing direction, of the heat exchanging portions 2*e* with respect to the dimension L of a portion, perpendicular to the direction parallel to the air flowing direction, of the heat exchanging portions 2*e*.

In this case, the ratio (=H/L) is defined as the ratio of the angle height H of the angle portions 2*c*, i.e. the dimension H of the part, of the heat exchanging portion 2*e*, parallel to the direction perpendicular to the air flow direction, with respect to the dimension L of the part thereof parallel to the air flow direction. Therefore, based on FIGS. 8 and 9, the summarized relationship between the ratio H/L and the heat exchanging ability is shown in FIG. 12.

Therefore, when the ratio (=H/L) of the angle height H of the heat exchanging portions 2*e* with respect to the dimension L of the part, of the heat exchanging portions 2*e*, parallel to the air flow direction is not smaller than 0.5 and not larger than 2.2, a high heat-exchanging ability can be attained.

(Sixth Embodiment)

In the fifth embodiment, the angle height H of the angle portions 2*c* and the pitch P between the heat exchanging portions 2*e* are determined so that the heat exchanging ability equal to or higher than the heat exchanging ability of the fins of the conventional heat exchanger provided with louvers, can be attained, though actual products vary in size, etc.

Due to this, in the sixth embodiment, as the 20% variation in the heat exchanging ability is taken into consideration, the angle height H of the angle portions 2*c* is set to 0.06 mm or higher and 0.36 mm or lower and, at the same time, the pitch P between the heat exchanging portions 2*e* is set to 0.08 mm or larger and 0.68 mm or smaller.

(Seventh Embodiment)

Figure 13A:
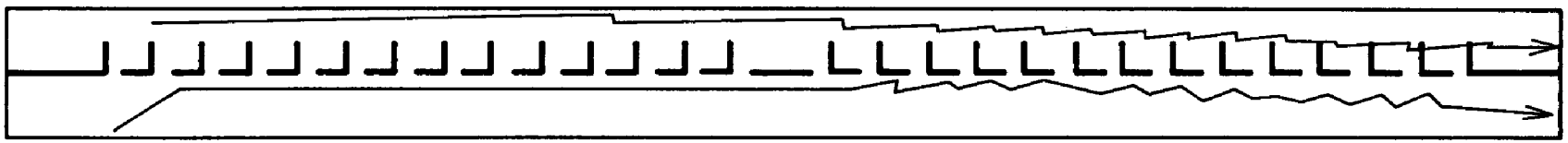
FIG. 13A is an exemplary drawing showing an air flow over the angle portions 2*c*.
Figure 13B:
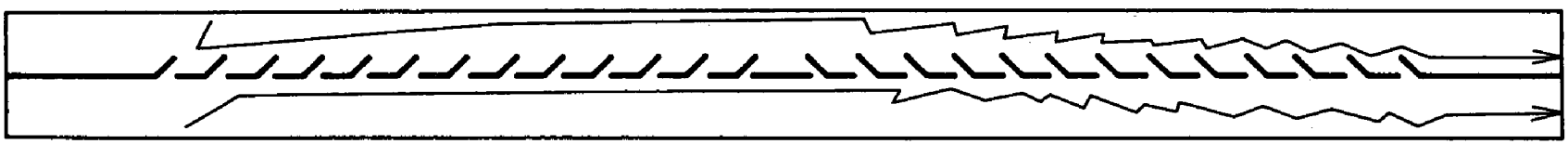
FIG. 13B is an exemplary drawing showing another air flow over the angle portions 2*c*.

In the embodiment described above, when the air flow meanders around the angle portions 2*c* (particularly, around the angle portions 2*c* in the downstream side of the air flow) as shown in FIG. 13A, the heat exchanging ability (the heat transfer coefficient) is improved and therefore the cut and raised angle θ of the angle portions 2*c* is not limited to the substantially 90 degrees and, as shown in FIG. 13B, parts of the plane portion 2*a* may be cut and raised up to the extent that the air flow can meander.

Therefore, in the seventh embodiment concretely, the cut and raised angle θ of the angle portions 2*c* can be not smaller than 40 degrees and not larger than 140 degrees. Therefore, the sectional shape of the heat exchanging portions 2*e* is not limited to the L shape and it may have, for example, various sectional shapes as shown in FIGS. 14A to D and FIGS. 15A to D.

In this case, the cut and raised angle θ of the angle portions 2*c* means the angle formed by cutting and raising up the plane portion 2*a* from the reference state in which the plane portion 2*a* is not cut and raised up.

Figures 14A, 14B, 14C, 14D:
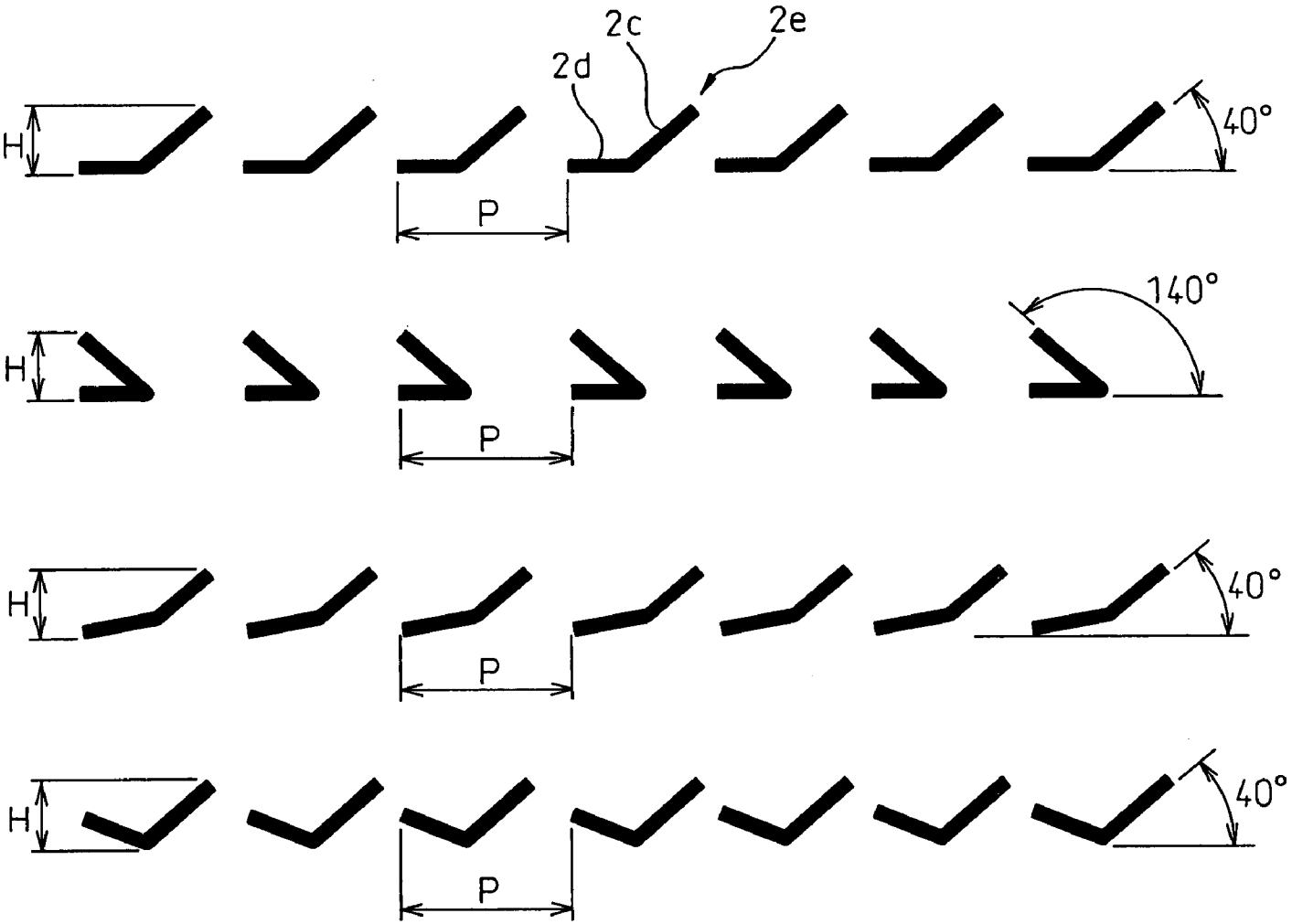
FIG. 14A is a sectional view of a fin showing an arrangement of angle portions according to a seventh embodiment of the present invention.
FIG. 14B is a sectional view of a fin drawing showing an arrangement of another angle portions according to the seventh embodiment of the present invention.
FIG. 14C is a sectional view of a fin showing an arrangement of another angle portions according to the seventh embodiment of the present invention.
FIG. 14D is a sectional view of a fin showing an arrangement of another angle portions according to the seventh embodiment of the present invention.

FIG. 14A shows an example in which the cut and raised angle θ is about 40 degrees, FIG. 14B shows an example in which the cut and raised angle θ is about 140 degrees, and FIGS. 14C and 14D show examples in which while the cut and raised angle θ is about 40 degrees, the slit pieces 2*d* are also bent to be inclined with respect to the plane portion 2*a*.

Figures 15A, 15B, 15C, 15D:
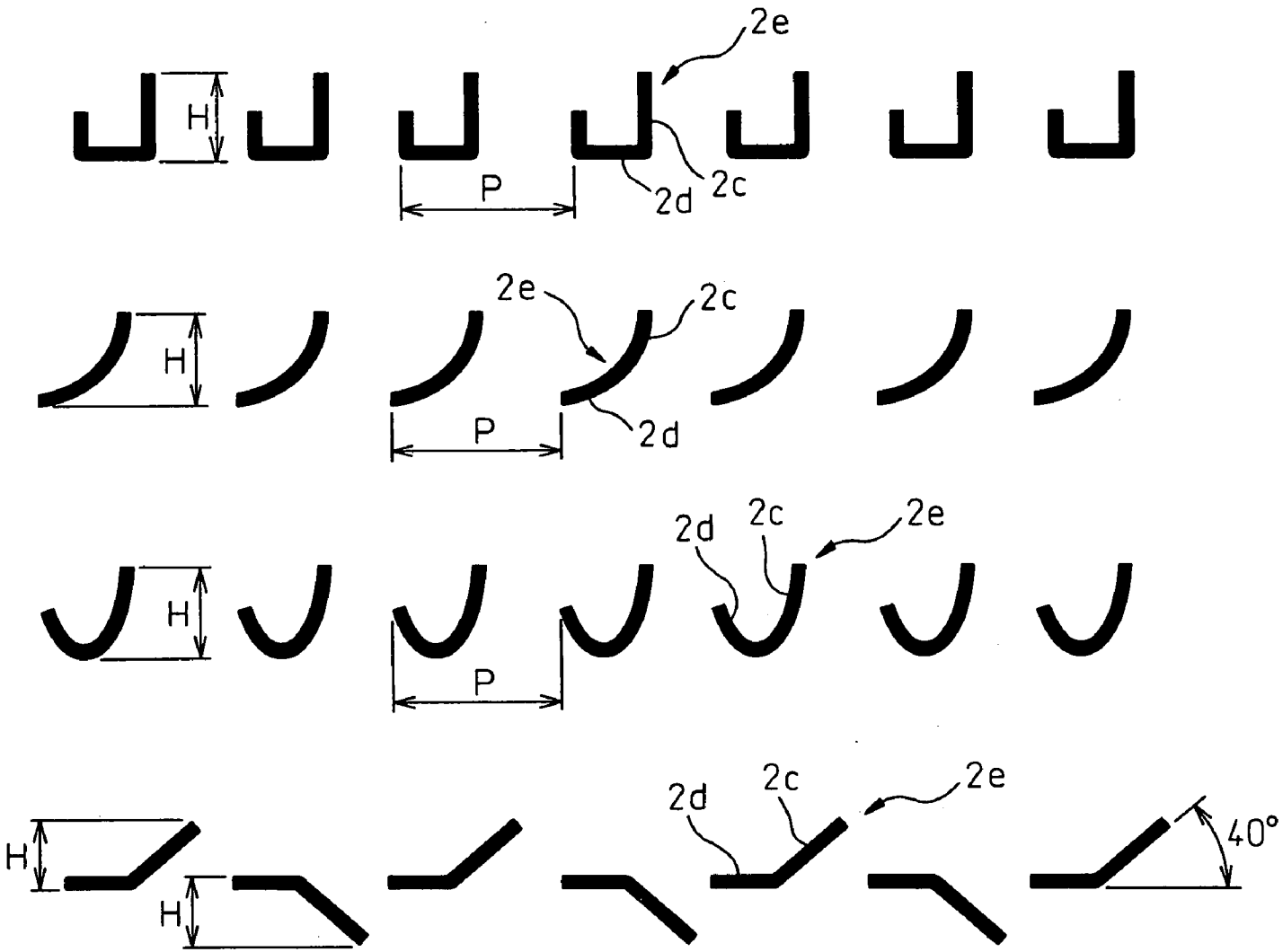
FIG. 15A is a sectional view of a fin showing an arrangement of yet another angle portions according to the seventh embodiment of the present invention.
FIG. 15B is a sectional view of a fin showing an arrangement of yet another angle portions according to the seventh embodiment of the present invention.
FIG. 15C is a sectional view of a fin showing an arrangement of yet another angle portions according to the seventh embodiment of the present invention.
FIG. 15D is a sectional view of a fin showing an arrangement of yet another angle portions according to the seventh embodiment of the present invention.

FIG. 15A shows an example in which part of the slit piece 2*d* present in the opposite side of the angle portion 2*c* is bent so as to be raised up in the direction similar to the angle portion 2*c*. FIG. 15B shows an example in which the angle portions 2*c* are cut and raised so that smooth arch-like curved surfaces are formed from the slit pieces 2*d* to the angle portions 2*c*. FIG. 15C shows an example in which while smooth arch-like curved surfaces are formed from the slit pieces 2*d* to the angle portions 2*c*, part of the slit piece 2*d* present in the opposite side of the angle portion 2*c* is bent into a curved surface in the direction similar to the angle portion 2*c*. FIG. 15D shows an example in which the directions of the raised parts of the angle portions 2*c* are alternately changed.

(Eighth Embodiment)

An eighth embodiment relates to the number of the heat exchanging portions 2*e*, i.e. the angle portions 2*c*.

Figure 16:
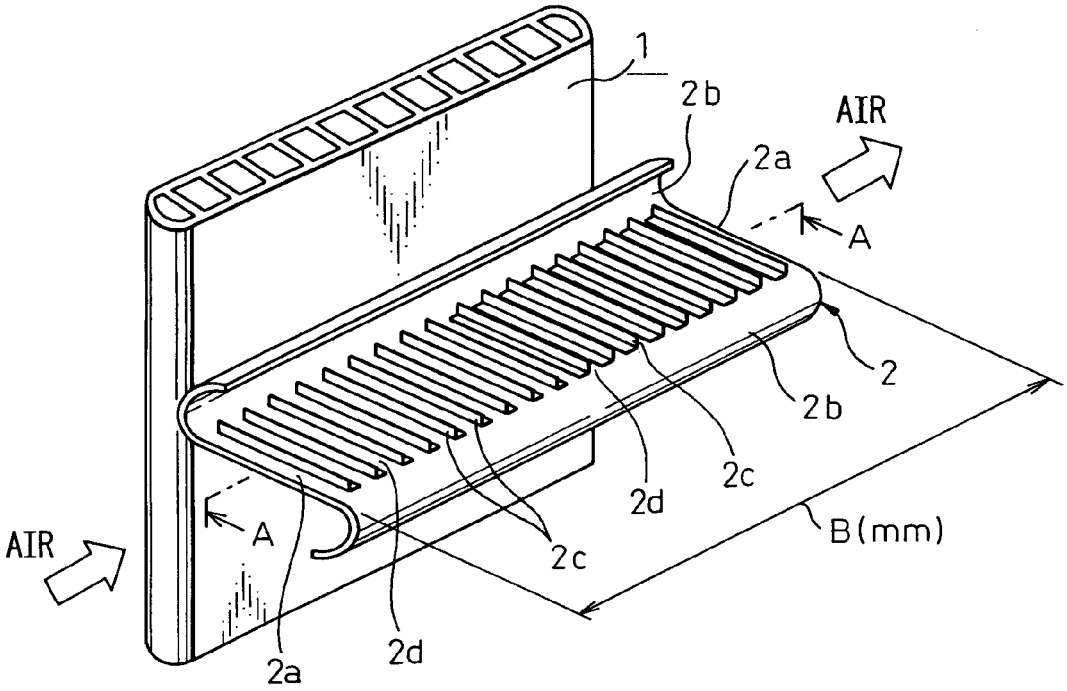
FIG. 16 is a perspective drawing of major components of a heat exchanger according to an eighth embodiment of the present invention.

More particularly, when the dimension B of the part, of the plane portion 2*a*, parallel to the air flow direction is expressed in centimeters, the number n of the heat exchanging portions 2*e*, as shown in FIG. 16, is set to larger than the value of B/0.75.

That is, the number n (n is a natural number) of the heat exchanging portions 2*e* is expressed by the following equation (1).

$$n>(B/0.75) \quad (1)$$

(Ninth Embodiment)

Figure 17:
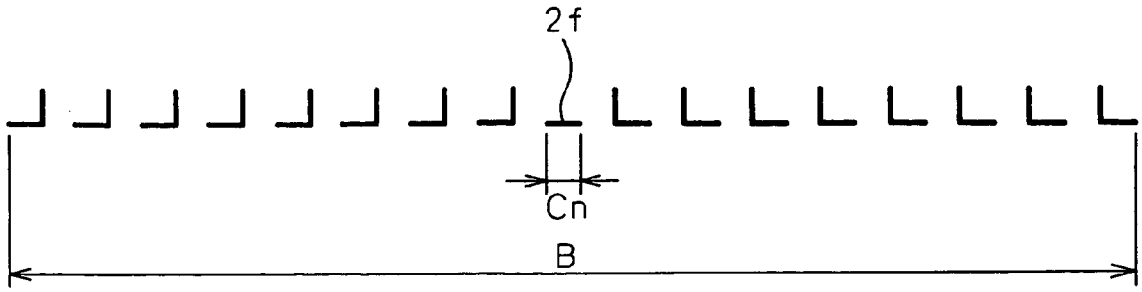
FIG. 17 is a sectional view of a fin of a heat exchanger according to an ninth embodiment of the present invention.

In a ninth embodiment, as shown in FIG. 17, at least a flat portion 2*f* on which the angle portion 2*c* is not formed is provided between the heat exchanging portions 2*e* adjacent to each other in the air flow direction and, at the same time, the dimension B of the plane portion 2*a* parallel to the air flow direction is made equal to or larger than 5 mm and equal to or smaller than 25 mm. In addition, the dimension Cn of the flat portion 2*f* parallel to the air flow direction is set to the predetermined dimension (0.5 mm in this embodiment) which is smaller than 1 mm.

In this way, it is possible to reduce the air flow resistance.

(Tenth Embodiment)

Figure 18:
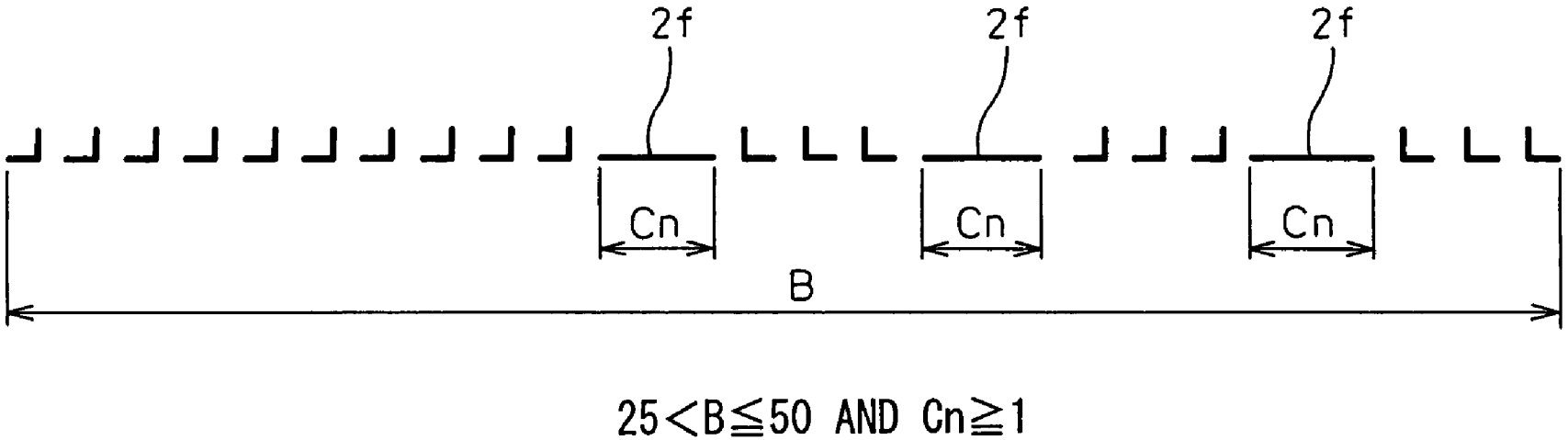
FIG. 18 is a sectional view of a fin of a heat exchanger according to a tenth embodiment of the present invention.

In a tenth embodiment, as shown in FIG. 18, a plurality of the flat portions 2*f* (three in FIG. 18) on which the angle portion 2*c* is not formed is provided between the heat exchanging portions 2*e* adjacent to each other in the air flow direction and, at the same time, the dimension B of the plane portions 2*a* parallel to the air flow direction is made larger than 25 mm and smaller than 50 mm. In addition, the dimension Cn of the flat portions 2*f* parallel to the air flow direction is set to the predetermined dimension (5 mm in this embodiment) which is not smaller than 1 mm and not larger than 20 mm.

In this way, it is possible to reduce an air flow resistance.

(Eleventh Embodiment)

Figure 19:
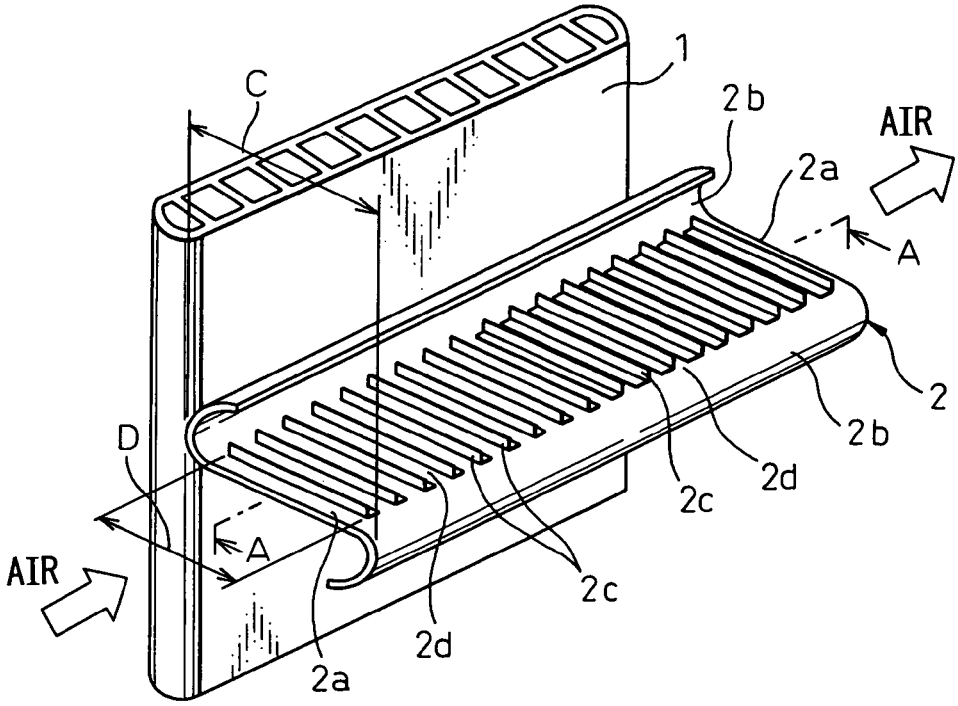
FIG. 19 is a perspective drawing of major components of a heat exchanger according to an eleventh embodiment of the present invention.

FIGS. 19 to 23 shows an eleventh embodiment. In the eleventh embodiment, as shown in FIGS. 19, when assuming that the length of the fin 2 orthogonal to the air flow direction is defined as C, the length of the angle portion 2*c* orthogonal to the air flow direction is defined as D, and the ratio (D/C) of the length C with respect to the length D is defined as a slit length ratio E, the slit length ratio E is set within an optimum range in order to improve the heat-exchanging performance of the fin 2.

Figure 20:
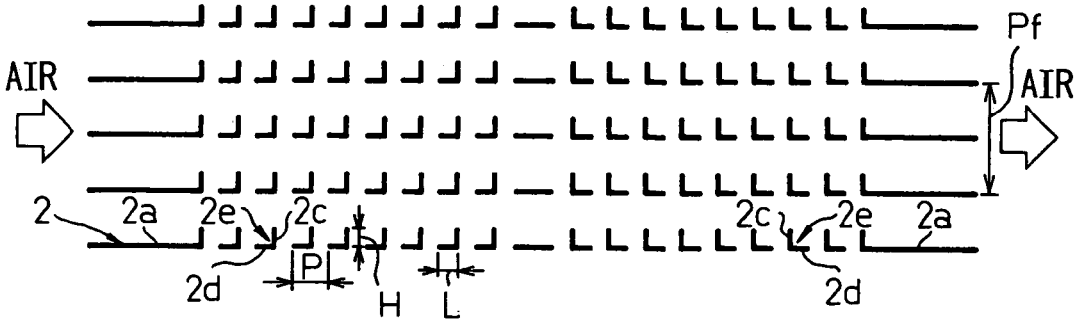
FIG. 20 is a sectional view taken along a line A—A in FIG. 19.
Figure 22:
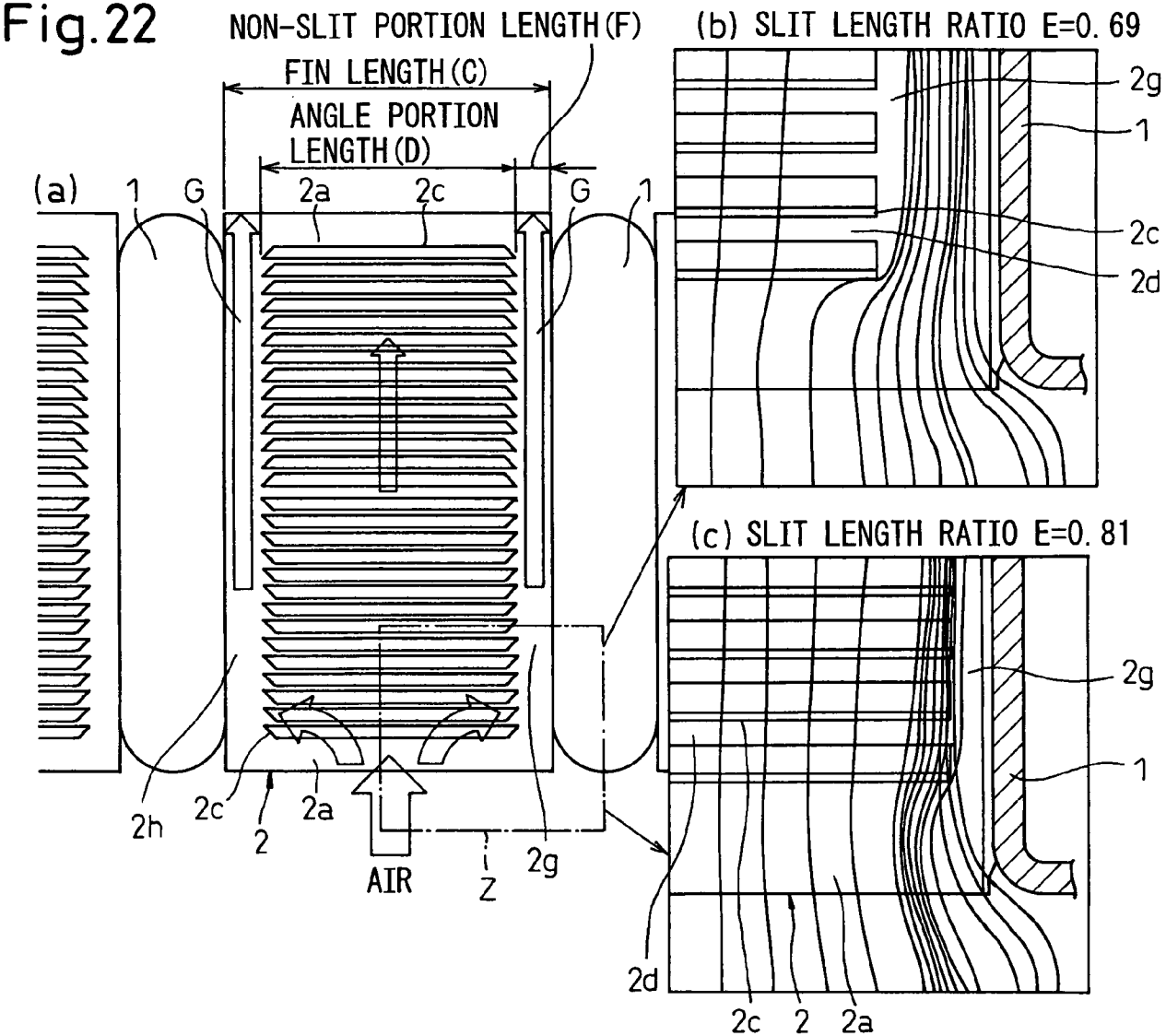
FIG. 22 is a plan view of major components for illustrating an effect of the eleventh embodiment of the present invention, (a) shows a general view, and (b) and (c) show enlarged views of Z portion in (a).

In this case, the length C of the fin 2 orthogonal to the air flow direction coincides with the interval length between the adjacent tubes 1 as shown in FIG. 22. FIG. 20 is a sectional view along line A—A in FIG. 19.

Figure 21:
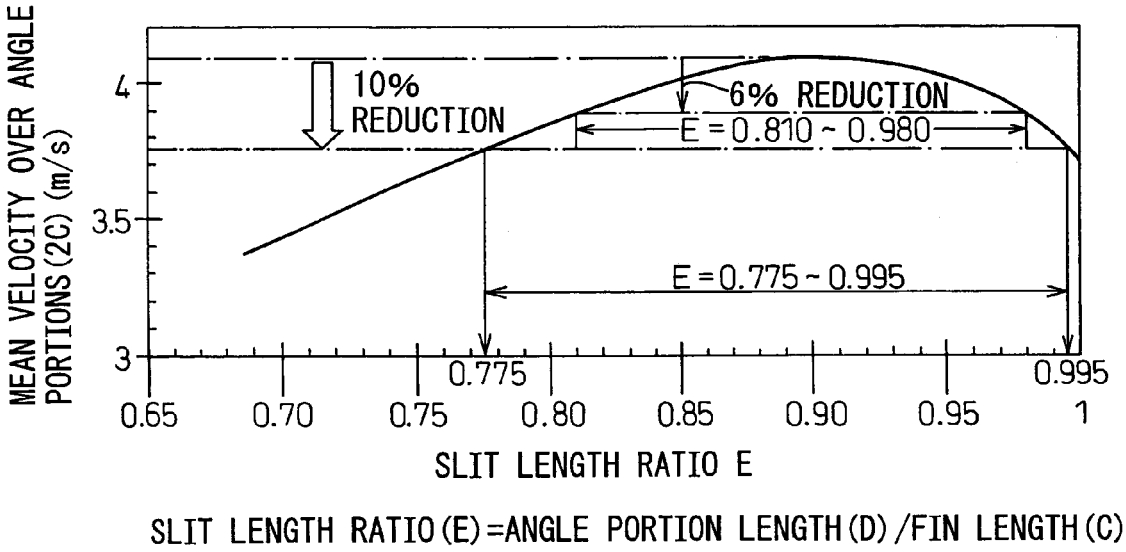
FIG. 21 is a graph showing the relationship between the slit length ratio E and the mean air flow velocity of angle portions, according to the eleventh embodiment.

FIG. 21 shows a graph representing a relationship between the slit length ratio E and the mean velocity of air flow passing through over the angle portions 2*c* (see FIG. 13) and the graph shows the calculation result of a numerical simulation performed by the applicant.

The main conditions of the numerical simulation include the pitch dimension P between the adjacent heat-exchanging portions 2*e*, shown in FIG. 20, equal to 0.5 mm, the dimension L of the air flow direction of the heat-exchanging portions 2*e* equal to 0.25 mm, the angle height H equal to 0.25 mm, the fin pitch of the corrugated fins 2 Pf equal to 2.5 mm, and the air velocity in front of the heat exchanger equal to 4 m/s.

In this numerical simulation, the angle (portion) length D is fixed to 4.5 mm and the fin length C is varied, so that the variation of the mean velocity of air flow according to the variation of the slit length ratio E is calculated.

In this stage, the phenomenon in which the mean velocity of the air flow varies according to the variation of the slit length ratio E is explained with reference to FIGS. 22 and 23. FIGS. 22(*b*) and 22(*c*) are enlarged views of the Z portion in FIG. 22(*a*), FIG. 22(*b*) shows an air flow in a case where the slit length ratio E (D/C) is set to 0.69 and FIG. 22(*c*) shows an air flow in a case where the slit length ratio E (D/C) is set to 0.81.

Non-slit portions 2*g* and 2*h* are formed on both side surfaces, of the angle portions 2*c*, in the plane portion 2*a* of the fin 2 and air bypassing the angle portions 2*c* flows over the non-slit portions 2*g*, 2*h* in the direction indicated by the arrow G in FIG. 22(*a*). In this case, FIG. 22(*b*) shows a state in which the slit length ratio E (D/C) is decreased to 0.69 by increasing the length F of the non-slit portions 2*g*, 2*h*.

Thus, if the slit length ratio E is decreased, the proportion of a flow rate of air, bypassing the angle portions 2*c* and flowing over the non-slit portions 2*g*, 2*h* in the direction indicated by the arrow G, with respect to the total air flow is not negligible as shown in FIG. 22(*b*). As a result, when the slit length ratio E is equal to 0.69 the air flow velocity becomes the maximum at the non-slit portions 2*g*, 2*h* which are provided outside the angle portions 2*c* in the longitudinal direction of the angle portions 2*c*, as shown by a dotted line in FIG. 23A, and, accordingly, the velocity of air flowing over the angle portions 2*c* is decreased.

Figure 23A:
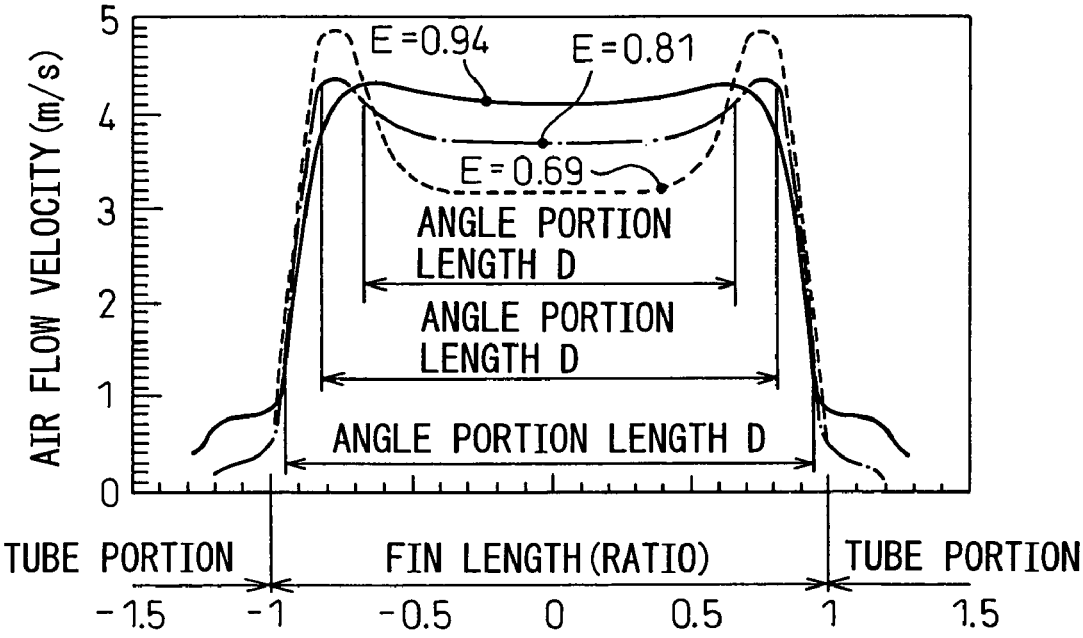
FIG. 23A is a graph showing the distribution of the air flow velocity in the longitudinal direction of the fin.
Figure 23B:
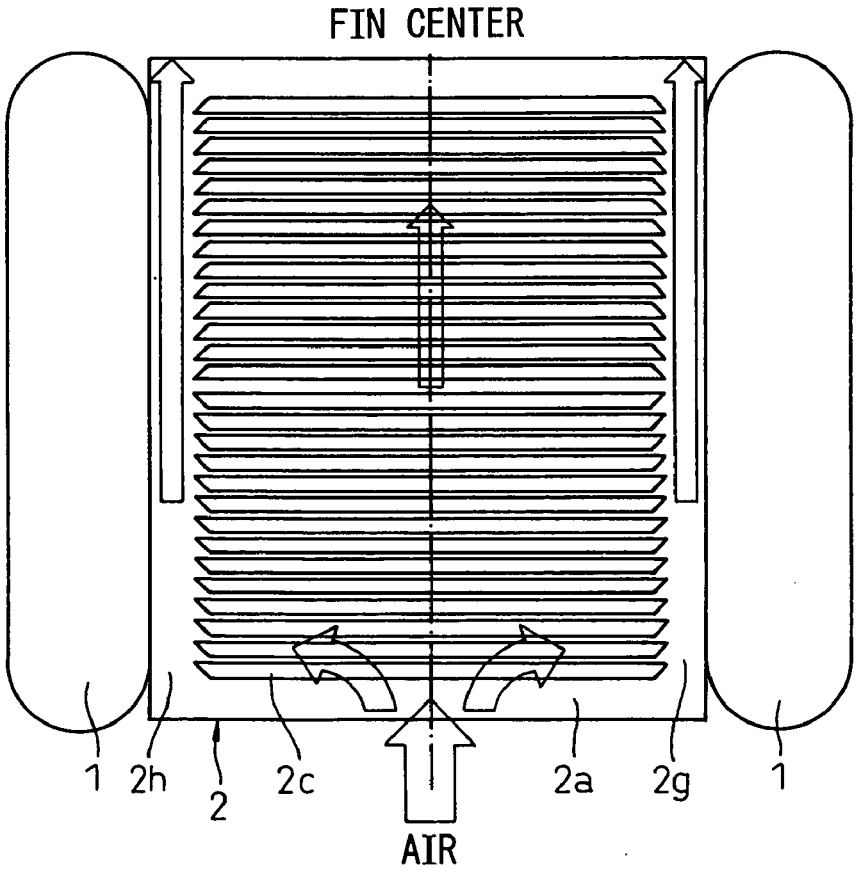
FIG. 23B is a plan view of major components showing a configuration corresponding to FIG. 23A in longitudinal direction of the fin of a horizontal axis thereof.

The horizontal axis in FIG. 23A represents a ratio of the position orthogonal to an air flow direction of fins 2, which is measured from the center of the fin 2, with respect to the fin length C. In other words, the center of the fin length C is defined as 0 and the lengths from the center 0 to the side end portions of the fin 2 are defined as +1 and −1, respectively. Therefore, the total length C of the fin 2 is defined as 2, in the horizontal axis of FIG. 23A.

On the other hand, if the slit length ratio E is increased to 0.81 as shown in FIG. 22(*c*), the length F of the non-slit portions 2*g*, 2*h* is decreased, so that air hardly passes over the non-slit portions 2*g*, 2*h*. Thereby, the distribution of the air velocity is made uniform and the velocity of air passing over the angle portions 2*c* can be increased as shown by an alternate long and short line in FIG. 23A.

Further, if the slit length ratio E is increased to around 0.94, the velocity of air passing over the angle portions 2*c* can be further increased as shown by a solid line in FIG. 23A. If the slit length ratio E is increased to approach to "1", the both ends in a longitudinal direction of the angle portions 2*c* approach to the wall surfaces of the tubes 1 (or the bent portions 2*b* of the fin), so that the influence of the flow resistance due to the wall surface of the tube 1 (or the bent portions 2*b* of the fin 2) is increased so as to decrease the air flow velocity. Therefore, the mean air velocity of air passing over the angle portions 2*c* is decreased.

As there is a relation where the heat transferring performance (heat transfer coefficient at the air side) of the fin 2 is improved in accordance with the increase of the mean air velocity of the air passing over the angle portions 2*c*, by selecting the slit length ratio E within the optimum range the heat transferring performance of the fin 2 can be effectively improved.

In FIG. 21 which shows a relationship between the slit length ratio E and the mean air velocity of the air passing over the angle portions 2*c*, the mean air velocity takes the maximum around the slit length ratio E=0.90. Thus, in order to improve the heat transferring performance of the fin 2 it is most effective to set the slit length ratio E around 0.90. When taking the variation of the slit length ratio E, of actual products and the like, into consideration, however, the allowable degrading range of the heat transferring performance thereof is, in practice, such that the air flow velocity decrease from the maximum air flow velocity is within the range of substantially 10%.

Therefore, the range of the slit length ratio E is set not less than 0.775 and not larger than 0.995. whereby, the heat transferring performance of the fin 2 can be effectively improved. If the slit length ratio E is set not less than 0.810 and not larger than 0.980, the air flow velocity decrease from the maximum air flow velocity is within the range of substantially 6% which is more preferable for the improvement of the heat transferring performance of the fin 2.

(Twelfth Embodiment)

Figure 24:
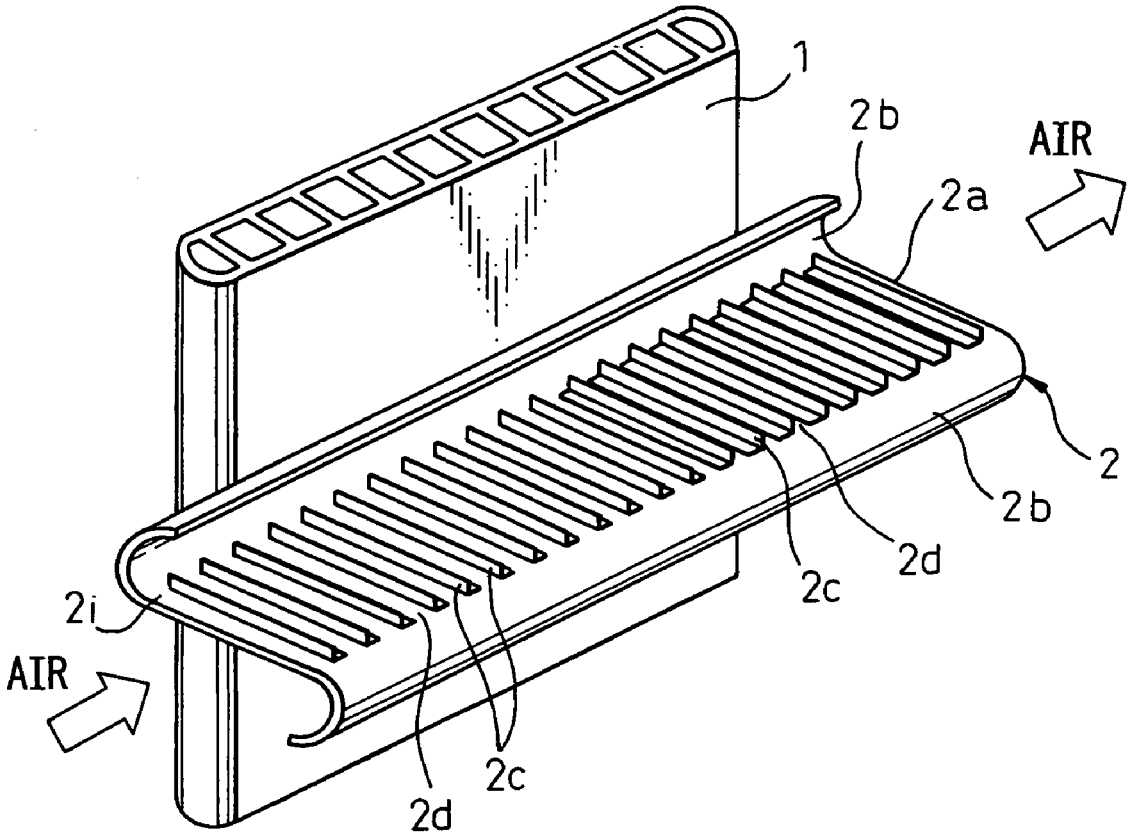
FIG. 24 is a perspective drawing of major components of a heat exchanger according to a twelfth embodiment of the present invention.

FIG. 24 shows a twelfth embodiment of the present invention. In the twelfth embodiment, a protrusion 2*i* which protrudes in the upstream side of an air flow from the position of the tube 1 end is formed on the fin 2 and angle portions 2*c* are also continuously formed on the protrusion 2*i*. The above construction is made because of the following reason.

Figure 25:
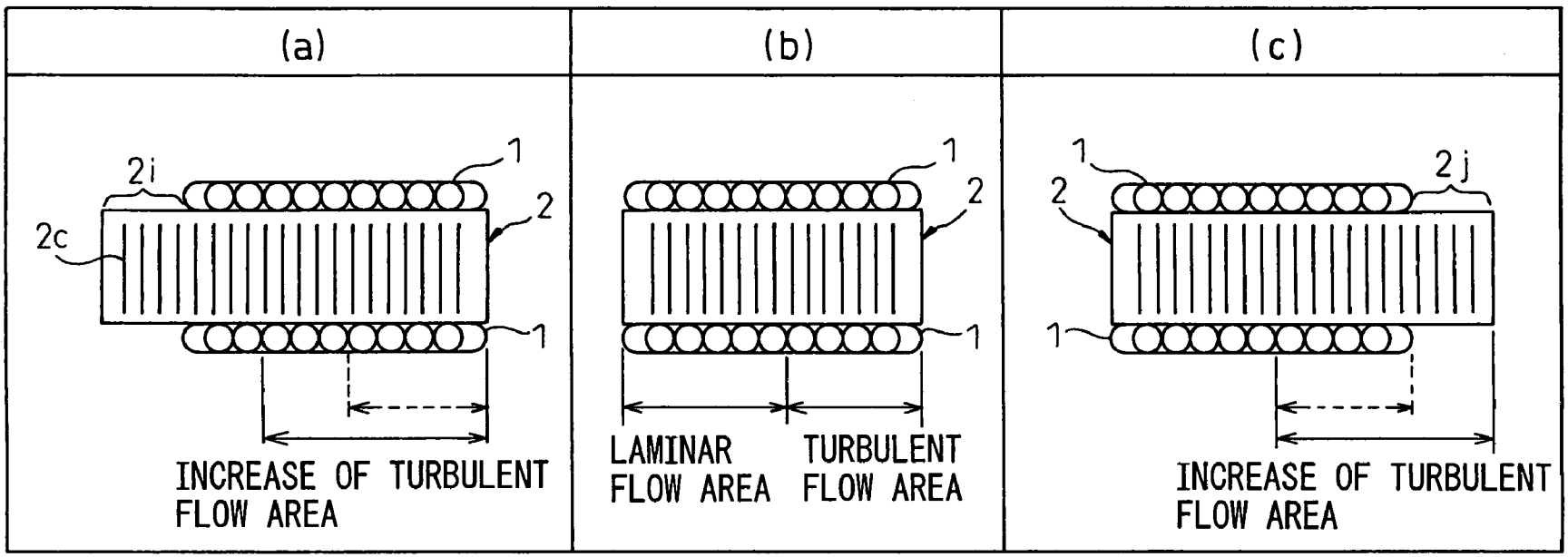
FIG. 25 shows, in (a), a plan view of major components of a heat exchanger according to the twelfth embodiment of the present invention, and (b) and (c) show plan views of major components of examples in comparison with the twelfth embodiment.

FIG. 25(*b*) shows an example in comparison with the twelfth embodiment. In the example, the upstream-side end and the downstream-side end, in the air flow, of the fin 2 coincide with the upstream-side end and the downstream-side end, in the air flow, of the tube 1, respectively, likely as the first embodiment, etc. Therefore, in the example the protrusion 2*i* of the fin 2 according to the twelfth embodiment is not provided.

The angle portions 2*c* produce a turbulent air flow and improve the heat transferring performance of the fin. However, it appears, according to the precise study of the applicant through experiment, that even if the angle portions 2*c* are formed, a laminar flow area is formed on an inlet area in the upstream of the air flow of the fin 2, as shown in FIG. 25(*b*), and a turbulent flow area, that is, an area with a high heat transfer coefficient, is formed on the downstream side of the laminar flow area.

In the twelfth embodiment the above-mentioned point is focused on so that the protrusion 2*i* which protrudes in the upstream side of an air flow from the position of the tube 1 end is formed on the fin 2 and the angle portions 2*c* are continuously formed on the protrusion 2*i*.

According to the twelfth embodiment, and also on the protrusion 2*i* protruding in the upstream side of an air flow of the fin 2 a turbulent air flow by the angle portions 2*c* begins to be produced, a turbulent air flow area having a high heat transfer coefficient can be shifted to the more upstream side of an air flow than the example in FIG. 25(*b*), as shown in FIG. 25(*a*). Thereby, an area having high heat transfer coefficient and formed on a portion of the fin 2 which contacts with the wall surface of the tube 1 is increased from the area of an example for comparison in FIG. 25(*b*) (indicated with the dotted line with arrows in FIG. 25(*a*)) to the area indicated with the solid line with arrows, in FIG. 25(*a*), so that it is possible to effectively improve the heat transferring performance of the fin.

According to the applicant's study, the protruding length of the protrusion 2*i* is preferably set to a length in which at least two angle portions 2*c* can be formed within the protrusion 2*i*, in order to improve the heat transferring performance of the fin.

In FIG. 25(*c*) showing another example for comparing with the twelfth embodiment, a protrusion 2*j* protruding into the downstream side of an air flow from the position of the end of the tube 1 is formed on the fin 2. According to the another example, it is possible to produce a turbulent air flow area having a high heat transfer coefficient on the protrusion 2*j* protruding into the air flow downstream side, so that the turbulent air flow area having a high heat transfer coefficient can be increased from the area of the example for comparison in FIG. 25(*b*) (indicated with the dotted line with arrows in FIG. 25(*c*)) to the area indicated with the solid line with arrows, in FIG. 25(*c*).

However, as the protrusion 2*j* protruding into the air flow downstream side is provided away from the wall surfaces of the tubes 1, the heat of hot fluid inside the tube 1 is difficult to reach the protrusion 2*j*. As a result, according to the another comparison example in FIG. 25(*c*) the turbulent air flow area having a high heat transfer coefficient due to the protrusion 2*j* protruding into the air flow downstream side cannot be effectively utilized for the improvement of the heat transferring performance of the fin.

On the other hand, the formation of the protrusion 2*j* causes the air flow resistance to be increased and may cause a trouble which decreases the heat radiating performance of a heat exchanger.

Accordingly, an arrangement where the fin 2 does not protrude into the more downstream side of the air flow than the downstream-side end of the tube 1, in other words, an arrangement where the downstream side end in an air flow of fin 2 coincides with that of the tube 1 in an air flow direction (see FIG. 25(*a*)), is advantageous in order to ensure a sufficient heat radiating performance of a heat exchanger.

In this configuration, the coincidence in the arrangement where the downstream side end in an air flow of fin 2 coincides with that of the tube 1 means the substantial coincidence which allows a small difference between the two ends thereof, due to a variation in assembling or the like.

(Other Embodiments)

In the embodiments described above, the heat exchanging portions 2*e*, i.e. the angle portions 2*c*, are formed so as to be arranged on the plane portion 2*a* in a row in the air flow direction. However, the present invention is not limited to these embodiments and may have an arrangement in which the number of the rows of the heat exchanging portions 2*e* is, for example, equal to two or more than two.

In the embodiments described above, the sectional shape of the heat exchanging portions 2*e* at the upstream side in the air flow and the sectional shape of the heat exchanging portions 2*e* at the downstream side in the air flow are substantially symmetric with each other but the present invention is not limited to these embodiments.

In the embodiments described above, the number of the angle portions 2*c* at the upstream side in the air flow and the number of the angle portions 2*c* at the downstream side in the air flow are equal but the present invention is not limited to these embodiments.

In the embodiments described above, the present invention is applied to a heat radiator of an air conditioner for a vehicle but the application of the present invention is not limited to this and the present invention may be applied to equipment such as a heater core of an air conditioner for a vehicle, an evaporator or a condenser of a vapor compression type refrigerator or a radiator.

In the embodiments described above, the fins 2 are fabricated by the roller forming method but the present invention is not limited and the fins 2 may be fabricated by other methods, such as press forming.

In the embodiments described above, the tubes 1 and the fins 2 are connected by soldering. However the present invention is not limited and the tubes 1 and the fins 2 can be connected using a mechanical method by enlarging the diameter of the tubes 1.

While the invention has been described by reference to specific embodiments chosen for the purposes of illustration, it should be apparent that numerous modifications could be made thereto by those skilled in the art without departing from the basic concept and scope of the invention.

What is claimed is:

1. A heat transfer member made of a thin plate member, dipped in fluid and thereby supplying or receiving the heat between the heat transfer member and the field, wherein the heat transfer member comprises angle portions cut and raised up from the thin plate member, and plane portions having a plurality of heat exchanging portions comprising slit pieces continuously connected to root portions of the angle portions, and wherein an angle height H of the angle portions is not lower than 0.02 mm and is not higher than 0.4 mm, and a pitch dimension P between the heat exchanging portions adjacent each other in a fluid flowing direction is not lower than 0.02 mm and is not higher than 0.75 mm.

2. A heat transfer member, as set forth in claim 1, wherein a raised angle θ of the angle portions is not smaller than 40 degrees and is not larger than 140 degrees.

3. A heat transfer member, as set forth in claim 1, wherein the angle portions are cut and raised up in a curved shape from the thin plate member.

4. A heat transfer member, as set forth in claim 1, wherein a ration H/L between the angle height H and dimension L of portions, parallel to the fluid flow direction, of the heat exchange portions is not less than 0.5 and is not more than 2.2.

5. A heat transfer member, as set forth in claim 1, wherein a relationship between a sectional shape of the heat exchanging portions on an upstream side of a fluid flow and a sectional shape of the heat exchanging portions on a downstream side of the fluid flow is arranged substantially symmetrically with each other.

6. A heat transfer member, as set forth in claim 1, wherein the heat exchange portions are formed on the plane portions so as to align in a row in the fluid flowing direction.

7. A heat transfer member, as set forth in claim 6, wherein a number of the heat exchanging portions is larger than a value B/0.75 when a value B is a length of a portion, parallel to the fluid flowing direction, of the plane portions and is expressed in a unit of centimeter.

8. A heat transfer member, as set forth in claim 1, wherein at least a flat portion without the angle portion is provided between the heat exchange portions adjacent each other in the fluid flowing direction.

9. A heat transfer member, as set forth in claim 8, wherein a dimension B of a portion, parallel to a fluid flowing direction, of the plane portions is not smaller than 5 mm and is not larger than 25 mm and a dimension Cn of a portion, parallel to the fluid flowing direction, of the flat portions is predetermined and is smaller than 1 mm.

10. A heat transfer member, as set forth in claim 8, wherein a dimension B of a portion, parallel to a fluid flowing direction, of the plane portions is larger than 25 mm and is not larger than 50 mm and a dimension Cn of a portion, parallel to the fluid flowing direction, of the flat portions is not smaller than 1 mm and is not larger than 20 mm.

11. A heat transfer member, as set forth in claim 1, wherein when a ratio D/C between a length C of a thin plate member orthogonal to the fluid flow direction and a length D of the angle portions orthogonal to the fluid flow direction is assumed to be a slit length ration E, the slit length ratio E is set within a range not less than 0.775 and not larger than 0.995.

12. A heat transfer member made of a thin plate member, dipped in fluid and thereby supplying or receiving the heat between the heat transfer member and the fluid, wherein the heat transfer member comprises angle portions cut and raised up from the thin plate member, and plane portions having a plurality of heat exchanging portions comprising slip pieces continuously connected to root portions of the angle portions, and wherein an angle height H of the angle portions is not lower than 0.06 mm and is not higher than 0.36 mm, and a pitch dimension P between the heat exchanging portions adjacent each other in a fluid flowing direction is not lower than 0.08 mm and is not higher than 0.68 mm.

13. A heat transfer member, as set forth in claim 12, wherein a raised angle θ of the angle portions is not smaller than 40 degrees and is not larger than 140 degrees.

14. A heat transfer member, as set forth in claim 12, wherein the angle portions are cut and raised up in a curved shape from the thin plate member.

15. A heat transfer member, as set forth in claim 12, wherein a ratio H/L between the angle height H and dimension L of portions, parallel to the fluid flow direction, of the heat exchange portions is not less than 0.5 and is not more than 2.2.

16. A heat transfer member, as set forth in claim 12, wherein a relationship between a sectional shape of the heat exchanging portions on an upstream side of a fluid flow and a sectional shape of the heat exchanging portions on a downstream side of the fluid flow is arranged substantially symmetrically with each other.

17. A heat transfer member, as set forth in claim 12, wherein the heat exchange portions are formed on the plane portions so as to align in a row in the fluid flowing directions.

18. A heat transfer member, as set forth in claim 17, wherein a number of the heat exchanging portions is larger than a value B/0.75 when a value B is a length of a portion, parallel to the fluid flowing direction, of the plane portions and is expressed in a unit of centimeter.

19. A heat transfer member, as set forth in claim 12, wherein at least a flat portion without the angle portion is provided between the heat exchange portions adjacent each other in the fluid flowing direction.

20. A heat transfer member, as set froth in claim 19, wherein a dimension B of a portion, parallel to a fluid flowing direction, of the plane portions is not smaller than 5 mm and is not larger than 25 mm and a dimension Cn of a portion, parallel to the fluid flowing direction, of the flat portions is predetermined and is smaller than 1 mm.

21. A heat transfer member, as set forth in claim 19, wherein a dimension B of a portion, parallel to a fluid flowing direction, of the plane portions is larger than 25 mm and is not larger than 50 mm and a dimension Cn of a portion, parallel to the fluid flowing direction, of the flat portions is not smaller than 1 mm and is not larger than 20 mm.

22. A heat transfer member, as set forth in claim 12, wherein when a ratio D/C between a length C of a thin plate member orthogonal to the fluid flow direction and a length D of the angle portions orthogonal to the fluid flow direction is assumed to be a slit length ratio E, the slit length ratio E is set within a range not less than 0.775 and not larger than 0.995.

* * * * *